US005477874A

United States Patent [19]

Yura et al.

[11] Patent Number: 5,477,874

[45] Date of Patent: Dec. 26, 1995

[54] DISHWASHER

[75] Inventors: Masaki Yura, Ibaraki; Yukio Hirai, Takarazuka; Hirosi Oya, Sanda, all of Japan

[73] Assignee: Matsushita Electric Industrial Co., Ltd., Osaka, Japan

[21] Appl. No.: 105,692

[22] Filed: Aug. 13, 1993

[51] Int. Cl.[6] ..... B08B 3/02

[52] U.S. Cl. ..... 134/176; 134/179; 134/180; 134/105; 239/251

[58] Field of Search ..... 239/251; 134/176, 134/179, 180, 200, 56 D, 57 D, 58 D, 105

[56] References Cited

U.S. PATENT DOCUMENTS

| | | | |
|---|---|---|---|
| 1,314,622 | 9/1919 | Vaudreuil | 134/179 |
| 1,345,519 | 7/1920 | Vaudreuil | 134/179 |
| 1,408,077 | 2/1922 | Clinton | 239/227 |
| 2,351,342 | 6/1944 | Karlstrom | 134/179 |
| 3,468,486 | 9/1969 | Mercer . | |
| 3,496,949 | 2/1970 | Mercer | 239/251 |
| 3,771,725 | 11/1973 | Jenkins et al. | 239/251 |
| 3,918,644 | 11/1975 | Platt | 239/251 |

FOREIGN PATENT DOCUMENTS

| | | | |
|---|---|---|---|
| 2100590 | 8/1971 | Germany | 134/179 |
| 4-67828 | 3/1992 | Japan . | |
| 4-164430 | 6/1992 | Japan . | |
| 4-164428 | 6/1992 | Japan . | |
| 1286820 | 8/1972 | United Kingdom | 134/179 |

*Primary Examiner*—Frankie L. Stinson
*Attorney, Agent, or Firm*—Wenderoth, Lind & Ponack

[57] ABSTRACT

A dishwasher has a cleaning tank, a plurality of dish containers disposed vertically in the cleaning tank, and cleaning nozzles defining a plurality of jetting openings for jetting cleaning water. The cleaning nozzles include an upper arm nozzle disposed in a space below an upper dish container and rotating substantially horizontal, a first arm nozzle disposed in a space below a lower dish container and rotating substantially horizontal, and a second arm nozzle having a rotational axis spaced a predetermined distance from the rotational axis of the first arm nozzle and rotating on the first arm nozzle. The upper arm nozzle jets cleaning water toward the upper dish container. The first and second arm nozzles jet cleaning water toward the lower dish container. The second arm nozzle eccentric to the rotational axis of the first arm nozzle jets cleaning water over a wide angle.

16 Claims, 15 Drawing Sheets

DISHWASHER

BACKGROUND OF THE INVENTION

1. Field of the Invention

The present invention relates to a dishwasher for cleaning dishes or the like efficiently by jetting cleaning water from jetting openings thereof.

2. Description of the Related Arts

A conventional method for operating a dishwasher is described below with reference to FIG. 22. Upper and lower dish containers 102 and 103 for accommodating dishes are disposed vertically in a plurality of stages in a tank 101. Upon start of drive with detergent put into the tank 101, a predetermined amount of cleaning water is supplied to the tank 101. Then, cleaning water, including detergent, pressurized by the pump 104 is jetted from the nozzles 105 and 106. Then, cleaning water including leftover or the like washed away from dishes is discharged from the dishwasher. Thereafter, cleaning water is jetted vertically or obliquely upward from the jetting opening of each of the nozzles 105 and 106. As a result, the nozzles 105 and 106 are rotated substantially horizontally by a reaction to the jetting force. Accordingly, most of the cleaning water inclines in the direction opposite to the rotational direction of the nozzles 105 and 106, thus colliding with the dishes. The dishes are washed by the colliding force of the cleaning water, the detergent, and heat.

After the cleaning process which is performed for a predetermined period of time terminates, cleaning water including leftover or the like washed away from the dishes is discharged from the dishwasher. Then, cleaning water is supplied to the tank 101 again and jetted to the dishes from the nozzles 105 and 106 to wash the dishes again and then, the cleaning water is discharged from the dishwasher. These operations are performed four times before cleaning process terminates. The dishwasher further comprises a heater 107, a pump 104, and a control device 107 for controlling the operation of the heater 107 and the like.

In the above-described dishwasher, the pressure of the cleaning water jetted from the first nozzle 106 is greater than that of the second nozzle 105. Therefore, the lower dish container 103 is used to clean dishes on which rice, oil, egg or the like have been left. Since the first nozzle 106 comprises a single arm which rotates substantially horizontally, the rotation locus of the jetting opening of the first nozzle 106, namely, the jetting locus of cleaning water jetted from the first nozzle 106 is constant. That is, the cleaning water is not jetted to every portion of each dish at a uniform intensity, but is repeatedly jetted to particular portions thereof. Therefore, the dishwasher has a low cleaning efficiency. That is, cleaning water cannot be jetted to the entire space (region to be cleaned) including the dish containers 102 and 103 and the dishes. Therefore, it is necessary for the jetting opening to allow the generation of a great pressure and flow rate. Consequently, a large motive power is supplied to the first nozzle 106. Energy calculated from the discharge pressure of cleaning water and flow rate thereof is hereinafter referred to as motive power of cleaning water. Consequently, the pump 104 is required to have a great pressurizing capability and thus great noises are generated in operation and in addition, cleaning water drips to the tank 101 in a large quantity, thus generating great noises.

In addition, since the performance for cleaning the dishes on the lower dish container 103 is not favorable, in the final stage of washing process, it is likely that leftover washed away from dishes attaches to the back surfaces of the dishes. In particular, leftover washed away from dishes in the upper dish container 102 attaches to the back surfaces of the dishes placed in the lower dish container 103.

In the conventional dish container, dishes, in particular, a plate can be placed in the dish container with the upper surface thereof turned over. But the number of cleaning arm nozzles is two and disposed vertically and in addition, cleaning water is jetted from each arm in a fixed locus. Therefore, when dishes are jetted in a direction opposite to the direction in which cleaning water is jetted, the cleaning water has a very low cleaning performance and thus it is inconvenient to use the dishwasher.

In the dishwasher in which the first nozzle 106 and the second nozzle 105 are vertically disposed, the rotational region thereof is vertically great and thus a dish-accommodating region has to be small. Thus, a large number of dishes having a great diameter cannot be placed in the dish container. Thus, it is inconvenient to use the dishwasher.

Due to the improvement of cleaning efficiency, it is possible to greatly reduce the jetting pressure generated at the jet opening and the flow rate of cleaning water. But due to the reduction in circulation amount of cleaning water of the pump 104, leftover cannot be reliably collected by the filter 112 at a predetermined position thereof and is thus scattered on the bottom surface of the tank 101. Thus, the leftover is scattered on the bottom surface of the tank 101 and unsanitary.

Further, since the first nozzle 106 rotate in an upper plane and the second nozzle 105 rotate in a lower plane, the distance between the jetting opening of the second nozzle 105 and the dishes in the dish container 103 is different from the distance between the jetting opening of the first nozzle 106 and the dishes in the dish container 103. Thus, it is impossible to jet cleaning water to the dishes in an appropriate distance in dependence on the configuration of the jetting openings. In order to overcome this disadvantage, it is necessary to increase the motive power of cleaning water.

In a dishwasher according to U.S. Pat. No. 3,468,486, a cleaning nozzle comprising a first arm nozzle and a second arm nozzle is used to improve its cleaning performance. In the dishwasher, the rotation axis of the second arm nozzle is eccentric from that of the first arm nozzle. When the operation of the dishwasher is stopped or cleaning process terminates, the cleaning nozzle inclines to one side, namely, to the first arm nozzle, thus becoming stationary. Because the distance between the first arm nozzle and a heater disposed below the first arm nozzle is short, the temperature of the first arm nozzle becomes high during drying process. Therefore, if the first arm nozzle is made of an inexpensive and low-grade resin, it is thermally deformed. It is conceivable to compose the first arm nozzle of metal, but the first arm nozzle has a high temperature when drying process has terminated, which may cause an operator to be got burnt in the hand. In addition, in composing the cleaning nozzle of a metal plate, it is difficult to configure the cleaning nozzle which has a favorable cleaning performance and does not make a large noise.

Even though the cleaning nozzle is balanced between the left side thereof and the right side in weight, the cleaning nozzle inclines to either the first arm nozzle side or the second arm nozzle if the weight of cleaning water staying in the first arm nozzle is not balanced with that of cleaning water staying in the second arm nozzle. At this time, cleaning water remains inside the first arm nozzle or the second arm nozzle and thus leftover contained in the cleaning water is accumulated therein, thus giving a bad smell.

In the construction of the dishwasher according to U.S. Pat. No. 3,468,486, it cannot be said that cleaning water jetted into the tank cleans dishes with a very high efficiency. That is, cleaning water is jetted from a first jetting opening of the first arm nozzle to dishes in a narrow annular space while it is rotating on its axis. A second jetting opening of the second arm nozzle rotates on the rotation axis thereof, with the second jetting opening rotating on the rotation axis of the first arm nozzle in accordance with the rotation of the first arm nozzle, thus jetting cleaning water toward the dishes. In combination of the first and second jet openings, cleaning water can be jetted uniformly and in a wide angle toward the dishes. But the cleaning range covered by the second jetting opening is very large. Therefore, the energy of cleaning water per area decreases by geometrical progression from the center of the cleaning tank toward the periphery thereof. In order to solve this problem, it is necessary to use a pump having a high motive power so as to jet cleaning water having a high energy from the first jetting opening to the outside region of the rotation locus of the second jetting opening. As a result, the magnitude of a downward moment generated by reaction, to jetting force, generated at the first jetting opening is much different from the magnitude of a downward moment generated by reaction, jetting force, generated at the rotation axis of the second arm nozzle. Consequently, an unbalance is generated vertically on the rotary plane of the first arm nozzle with respect to the rotation axis thereof 01 and thus the first arm nozzle is incapable of rotating horizontally. Accordingly, an unfavorable rotation occurs and as a result, a large quantity of water not contributing to dish washing leaks from a sealing portion, which reduces the cleaning performance of the dishwasher.

In order to solve this problem, it is necessary for the second arm nozzle to rotate on the rotation axis 01 of the first arm nozzle in a radius more than is required. But there are limitations to enlarging the distance between the rotation axis of the second arm nozzle and the position of the first jetting opening. As such, it is difficult to form the construction which allows the second arm nozzle to rotate horizontally on the rotation axis 01 of the first arm nozzle in a great radius.

Further, pipe resistance to pressurized cleaning water between the first arm nozzle and the second jetting opening is greater than pipe resistance to pressurized cleaning water on the first jetting opening side, and thus the discharge pressure of cleaning water jetted from the second jetting opening and the quantity of the cleaning water jetted therefrom are lower than those of cleaning water jetted from the first jetting opening by 10% to 20%. That is, the dishwasher has a problem that the cleaning water jetted from the second jetting opening has a small energy density and that the effective motive power of the cleaning water jetted from the second jetting opening is much lower than that of the cleaning water jetted from the first jetting opening.

In addition, only dishes in the lower dish container can be cleaned at a high efficiency. Therefore, dishes placed in the upper dish container cannot be cleaned as favorably as those in the lower dish container when rice, oil, egg or the like is on the dishes. Thus, there is a limitation to dish container-accommodating direction.

SUMMARY OF THE INVENTION

It is a first object of the present invention to provide a dishwasher having an improved cleaning efficiency, providing a high cleaning performance at a low motive power of cleaning water, and generating a small noise.

It is a second object of the present invention to provide a dishwasher in which leftover or the like can be prevented from attaching to the back surface of a dish by rotating upper and lower arm nozzles in opposite directions.

It is a third object of the present invention to provide a dishwasher having a high cleaning performance irrespective of dish-accommodating direction owing to the provision of two arm nozzles rotating in opposite direction and an upper arm nozzle.

It is a fourth object of the present invention to provide a dishwasher having a high cleaning efficiency and a large dish-accommodating region.

It is a fifth object of the present invention to provide a dishwasher which does not generate a bad smell and is thus sanitary.

It is a sixth object of the present invention to provide a dishwasher having a high cleaning performance at a small motive power of cleaning water.

It is a seventh object of the present invention to provide a dishwasher which is capable of maintaining of a cleaning nozzle at an appropriate temperature while dishes are being dried and thus safe to use.

It is an eighth object of the present invention to provide a dishwasher which allows cleaning water to be reliably discharged from a cleaning nozzle and is thus sanitary.

It is a ninth object of the present invention to provide a dishwasher and a drying apparatus which are capable of cleaning dishes uniformly by a high level energy density and has an arm nozzle rotating smoothly and horizontally.

It is tenth and eleventh objects of the present invention to provide a dishwasher which provides tenth and eleventh means.

It is a twelfth object of the present invention to provide a dishwasher comprising three arm nozzles so as to uniformly clean dishes accommodated in upper and lower dish containers, provide a high cleaning performance at a low motive power of cleaning water, and generate a small noise.

It is a thirteenth object of the present invention to provide a dishwasher which prevents leftover washed away from dishes from attaching to the back surfaces of dishes and provides a high cleaning performance irrespective dish-accommodating direction and thus convenient to use.

In order to accomplish the first object of the present invention, cleaning means of a dishwasher according to an upper means comprises: a first arm nozzle disposed in a space below an upper dish container and rotating substantially horizontally; a first arm nozzle disposed in a space below a lower dish container and rotating substantially horizontally; and a second arm nozzle having a rotation axis eccentric in a predetermined distance from the rotation axis of the first arm nozzle and rotating on the first arm nozzle.

According to the above-described construction, the cleaning water can be jetted to the dishes placed in the lower dish container in a wide angle from the jetting openings of the second arm nozzle. Therefore, the cleaning water can be jetted to every portion of each dish. That is, a predetermined cleaning performance can be obtained by a small motive power of cleaning water. A small motive power of the pump suffices for cleaning the dishes because the entire region in the dish container can be cleaned uniformly. Although the pump is small, it provides a high motive power for reliably and uniformly clean the dishes. In addition, the pump consumes a small electric power and generates a small noise.

In order to accomplish the second object of the present invention, cleaning means of a dishwasher according to a second means comprises: an upper arm nozzle disposed in a space below an upper dish container and rotating substantially horizontally; a first arm nozzle disposed in a space below a lower dish container and rotating substantially horizontally; and a second arm nozzle having a rotation axis eccentric in a predetermined distance from the rotation axis of the first arm nozzle and rotating on the first arm nozzle. In this construction, a plurality of jetting openings for jetting cleaning water toward dishes in the lower dish container is formed on a bottom surface of the upper arm nozzle; and the upper arm nozzle rotates in a direction opposite to that of either the first arm nozzle or that of the second arm nozzle.

According to the above-described construction, cleaning water is uniformly jetted toward the region to be cleaned. In addition, cleaning water is jetted from the arm nozzles in opposite directions. Both the upper and lower surfaces of dishes can be effectively cleaned. Further, leftover or the like washed away from dishes in the upper dish container can be prevented from attaching to the back surfaces of the dishes placed in the lower dish container.

In order to accomplish the third object of the present invention, cleaning means of a dishwasher according to a third means comprises: an upper arm nozzle disposed in a space below an upper dish container and rotating substantially horizontally; first and second arm nozzles disposed in a space below a lower dish container and rotating substantially horizontally; and the first and second arm nozzles being substantially concentric with each other and rotate in opposite directions.

According to the above-described construction, in cooperation of the upper arm nozzle and the first and second arm nozzles rotating in opposite directions, dishes can be favorably cleaned irrespective of dish-placing directions. Thus, the dishwasher is convenient to use.

In order to accomplish the fourth object of the present invention, a dishwasher according to a fourth means comprises: a cleaning tank; a dish container for accommodating dishes; a pump for pressurizing cleaning water; a cleaning nozzle having a plurality of jetting openings for jetting the cleaning water. The cleaning means comprises: a first arm nozzle, supported by a nozzle bearing, communicating with the pump and rotating substantially horizontally; and a second arm nozzle having a rotation axis eccentric from the rotation axis of the first arm nozzle and rotating on the first arm nozzle. In this construction, a bearing supporting the second arm nozzle is formed at a level lower than the level of an end of the first arm nozzle.

According to the above-described construction, the motion locus of the second arm nozzle covers a wide range and cleaning water is jetted from the jetting openings of the second arm nozzle at a wide angle. Therefore, the cleaning water can be uniformly jetted to the dishes. In addition, the dishwasher is convenient to use because the cleaning nozzle rotates in a smaller space and thus dish-accommodating region is larger than that of the conventional dishwasher.

In order to accomplish the fifth object of the present invention, cleaning means according to a fifth means comprises: a first arm nozzle, supported by a nozzle bearing, communicating with the pump and rotating substantially horizontally; and a second arm nozzle having a rotation axis eccentric from the rotation axis of the first arm nozzle and rotating on the first arm nozzle. In this construction, a bearing supporting the second arm nozzle is formed at a level lower than the level of an end of the first arm nozzle; and a jetting opening for jetting cleaning water is formed on a lower surface of the first arm nozzle.

According to the above-described construction, in addition to the operation of the first means of the present invention, cleaning water is jetted from the jetting opening formed on the lower surface of the first arm nozzle toward the bottom of the tank, thus cleaning the filter and the bottom of the tank. That is, leftover does not remain on the bottom of the tank, thus not emitting a bad smell. In this manner, the interior of the tank can be kept to be sanitary.

In order to accomplish the sixth object of the present invention, in addition to the first and second means, the cleaning means according to a sixth means comprises: the first arm nozzle, supported by the nozzle bearing, communicating with the pump and rotating substantially horizontally; and the second arm nozzle having the rotation axis eccentric from the rotation axis of the first arm nozzle and rotating on the first arm nozzle. In this construction, the jetting opening of the first arm nozzle is formed at a position in which the jetting opening of the first arm nozzle and a jetting opening of the second arm nozzle rotate in approximately the same plane.

According to the above-described construction, the distance between the jetting opening of the first arm nozzle and the dishes accommodated in the lower dish container is equal to the distance between the jetting opening of the second arm nozzle and the dishes accommodated in the lower dish container. Accordingly, the distance between the lower dish container and the first arm nozzle can be appropriately selected depending on the configuration of both jetting openings. That is, cleaning water can be jetted to dishes from each jetting opening in an appropriate distance. Hence, a high cleaning performance can be obtained by a small motive power of cleaning water.

In order to accomplish the seventh object of the present invention, in addition to the constructions of the above means, the cleaning nozzle according to a seventh means has its center of gravity at a position eccentric in a predetermined distance from the rotation axis of the first arm nozzle toward the rotation axis of the second arm nozzle.

According to the above-described construction, the cleaning nozzle inclines to the second arm nozzle side, thus becoming stationary. Therefore, the distance between the heater and the lower surface of the first arm nozzle as well as the lower surface of the second arm nozzle can be kept at a predetermined distance. Therefore, the temperature of every portion of the first arm nozzle and the second arm nozzle does not rise beyond a permissible range in drying process. Thus, the dishwasher is safe to use.

In order to accomplish the eighth object of the present invention, according to a seventh means, in addition to the constructions of the above means, the first arm nozzle has a projection formed on the lower surface thereof such that the projection is brought into contact with the nozzle bearing supporting the shaft of the first arm nozzle when the operation of the pump stops; and the lower surface of the projection is inclined with respect to a horizontal plane so that the vertical length of the projection is shorter on the second arm nozzle side than the side opposite to the second arm nozzle.

According to the above-described construction, when the operation of the pump has stopped, the lower surface of the projection formed on the lower surface of the first arm nozzle is brought into contact with the nozzle bearing. Accordingly, the cleaning nozzle reliably inclines to the second arm nozzle, thus becoming stationary. As a result, cleaning water and leftover or the like left in the cleaning nozzle in the cleaning process can be reliably discharged from the jetting opening. Thus, the dishwasher according to the eighth means is sanitary.

In order to accomplish the ninth object of the present invention, the cleaning means according to a ninth means comprises: a first arm nozzle communicating with a discharge opening of the pump and rotating substantially horizontally; and a second arm nozzle having a rotation axis eccentric from the rotation axis of the first arm nozzle and rotating on one arm of the first arm nozzle. In this construction, a plurality of first jetting openings is formed on the other arm of the first arm nozzle; a plurality of second openings is formed on the second arm nozzle; the number of the second jetting openings is greater than that of the first jetting openings; and the quantity of cleaning water jetted from the second jetting openings is greater than that of cleaning water jetted from the first jetting openings.

According to the above-described construction, as a result of the actuation of the pump, the second arm nozzle rotates on its axis and at the same time on the axis of the first arm nozzle in accordance with the rotation of the first arm nozzle, with cleaning water being jetted from the first and second openings. The number of the second jetting openings is set to be greater than that of the first jetting openings. Therefore, the flow rate of cleaning water jetted from the former is greater than that jetted from the latter. Accordingly, the motive power of cleaning water jetted from the second jet openings is great and thus, the energy density of the cleaning water jetted from the second jetting openings is uniform and thus the cleaning water can be uniformly jetted to dishes in the tank. Thus, the dishwasher is capable of cleaning dishes more uniformly and with a high level energy density than the conventional dishwasher. The total reaction F2, to the jetting force, of the second jetting openings is greater than the total reaction F1, to the jetting force, of the first jetting openings. Therefore, the magnitude of the reaction F2 and that of the reaction F1 at the rotation axis of the second arm nozzle are almost inversely proportional to the distance L1 between the rotation axis of the first arm nozzle and the position at which the reaction F1 is generated in the left arm thereof and the distance L2 between the rotation axis of the first arm nozzle and the position at which the reaction F2 is generated in the right arm thereof, respectively. The product of the distance L1 and the reaction F1 is almost equal to the product of the distance L2 and the reaction F2. Accordingly, the downward moments generated on the first arm nozzle about the rotation axis of the first arm nozzle are balanced with each other. Thus, the first and second arm nozzles rotate smoothly and water can be prevented from leaking from a rotary sealing portion.

It is necessary that the distance L2 is shorter than the average of the distance L1 by more than 30%. The magnitude of the reaction F2 and the reaction F1 are almost inversely proportional to the distance L1 and the distance L2, respectively as described above. Therefore, the first and second arm nozzles rotate smoothly and water leakage does not occur because an unbalance of the downward moments generated on the first arm nozzle can be solved. In this manner, dishes can be cleaned with a high efficiency by the smooth rotation of the first and second arm nozzles.

In order to accomplish the tenth object of the present invention, the cleaning means according to a tenth means comprises: a first arm nozzle communicating with a discharge opening of the pump and rotating substantially horizontally; and a second arm nozzle having a rotation axis eccentric from the rotation axis of the first arm nozzle and rotating on one arm of the first arm nozzle. In this construction, a plurality of first jetting openings is formed on the other arm of the first arm nozzle; a plurality of second openings is formed on the second arm nozzle; and the sectional area of a plane, at a given position, of the arm on the first jetting opening side is set to be smaller than that of a plane, at a given position, of the arm on the second arm nozzle side supposing that the thickness of the wall of one arm of the first arm nozzle is equal to the thickness of the wall of the other arm of the first arm nozzle. The two given points are symmetrical with respect to the rotation axis of the first arm nozzle.

According to the above construction, as a result of actuation of the pump 2, cleaning water is supplied from the first jetting opening into the first arm nozzle 64. The pipe resistance in the arm on the second arm nozzle side is smaller than that in the arm on the first jetting opening side, and thus pressure loss on the second arm nozzle side is smaller than that on the first jetting opening side. Therefore, the amount of cleaning water to be supplied to the second arm nozzle side is greater than that of cleaning water to be supplied to the first jetting opening side. That is, the flow rate in the second arm nozzle side is greater than that in the first jetting opening side. Thus, the discharge pressure at the second jetting opening can be suppressed to the minimum. Accordingly, the motive power of cleaning water at the second jetting opening is greater than the motive power of cleaning water at the first jetting opening, thus contributing to the improvement of energy density of cleaning water and cleaning efficiency. As a result, the downward moments generated on the first arm nozzle are balanced with each other, and water leakage from a rotary sealing portion can be reduced to the minimum. Thus, the cleaning water spreads over every portion of the dishes.

In order to accomplish the eleventh object of the present invention, the cleaning means according to an eleventh means comprises: a first arm nozzle communicating with a discharge opening of the pump and rotating substantially horizontally; and a second arm nozzle having a rotation axis eccentric from the rotation axis of the first arm nozzle and rotating on one arm of the first arm nozzle. In this construction, a plurality of first jetting openings is formed on the other arm of the first arm nozzle; a plurality of second openings is formed on the second arm nozzle; and a throttle vane is formed inside an arm on the first jetting opening side of the first arm nozzle so that the sectional area of a plane of the arm on the first jetting opening side is set to be smaller than that of a plane of an arm on the second arm nozzle side, supposing that the thickness of the wall of the first arm nozzle is constant.

According to the above-described construction, advantages similar to those of the eleventh means of the present invention can be obtained. That is, the second jetting opening contributes to the improvement of energy density of cleaning water and cleaning efficiency. Further, the downward moments generated on the first arm nozzle are balanced with each other. Thus, dishes can be cleaned with efficiency.

In order to accomplish the twelfth object of the present invention, according to a twelfth means, the cleaning means comprises: a first arm nozzle disposed in a space below the upper dish container and rotating substantially horizontally; a second arm nozzle disposed in a space below the lower dish container; and a third arm nozzle having a rotation axis eccentric in a predetermined distance from the rotation axis of the first arm nozzle and rotating on the first arm nozzle. In this construction, a plurality of jetting openings is formed on upper and lower surfaces of the third arm nozzle.

According to the above-described construction, jetting cleaning water is jetted toward dishes placed in the upper and lower dish containers at a wide angle from the jetting openings of the third jetting opening. Accordingly, the cleaning water can be jetted to every portion of each dish, thus cleaning the dishes efficiently. Accordingly, predetermined cleaning performance can be obtained by a smaller motive power of cleaning water. Further, water jetted from each jetting opening makes a small noise when it collides with the wall of the tank.

In order to accomplish the thirteenth object of the present invention, according to a thirteenth means, in addition to the construction of the twelfth means, the third arm nozzle rotates in a direction opposite to a direction in which the first arm nozzle rotates or a direction in which the second arm nozzle rotates.

According to the above-described construction, in addition to the advantage that every portion of each dish can be cleaned favorably, another advantage can be obtained. That is, the third arm nozzle rotates in the direction opposite to the direction in which the first arm nozzle or the direction in which the second arm nozzle rotate. Therefore, cleaning water is jetted to the upper and lower surfaces of each dish favorably and in addition, leftover or the like can be prevented from attaching to the back surfaces of the dishes. Further, irrespective of dish-placing directions, cleaning water can be reliably jetted to the dishes. Thus, the dishwasher is convenient to use.

BRIEF DESCRIPTION OF THE DRAWINGS

These and other objects and features of the present invention will become clear from the following description taken in conjunction with the preferred embodiment thereof with reference to the accompanying drawings, in which.

DETAILED DESCRIPTION OF THE INVENTION

Figure 1:
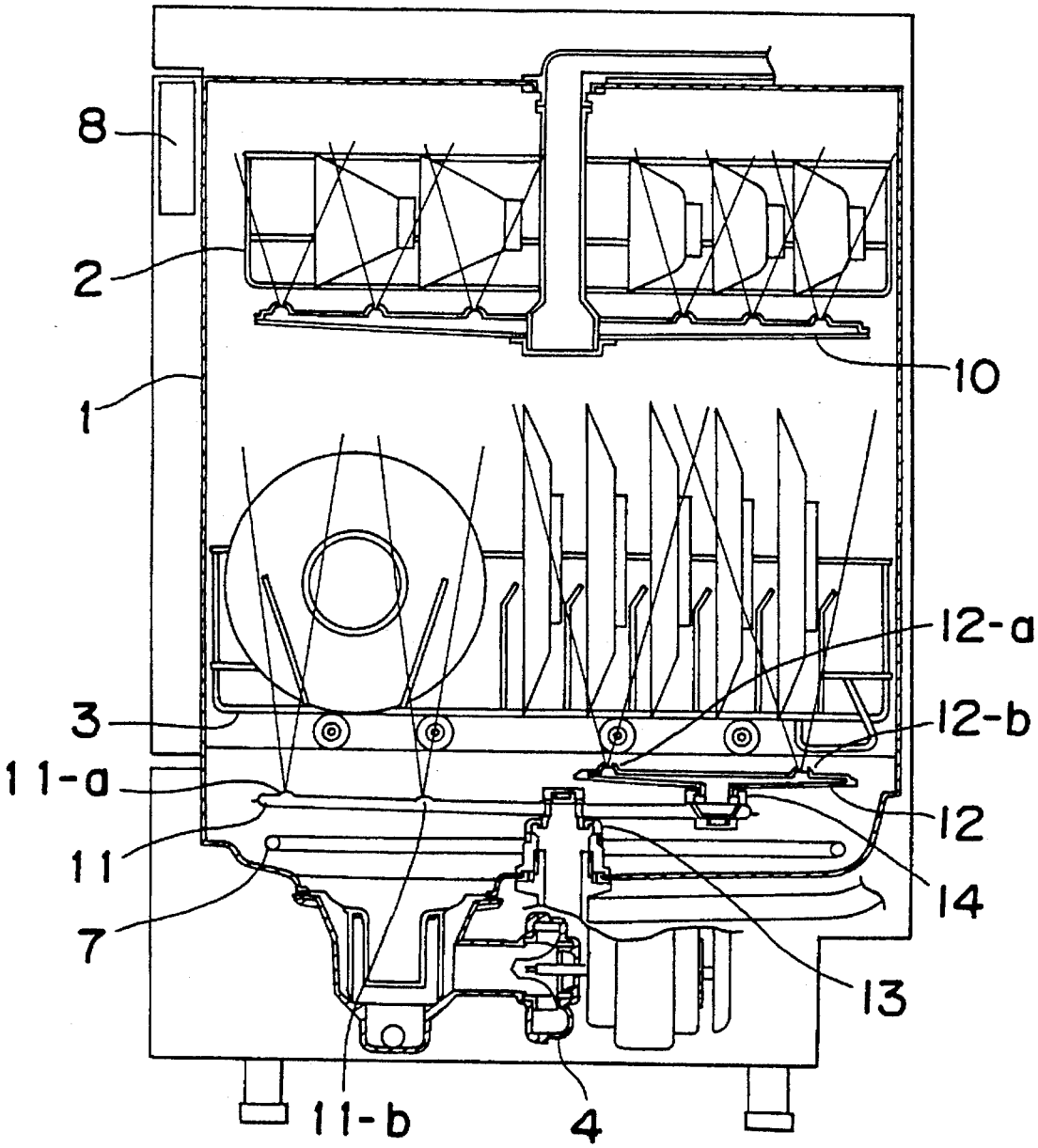
FIG. 1 is a sectional view showing a dishwasher according to a first embodiment of the present invention.

Before the description of the present invention proceeds, it is to be noted that like parts are designated by like reference numerals throughout the accompanying drawings.

Dishwashers according to embodiments of the present invention are described below with reference to the drawings.

First Embodiment

Figure 2:
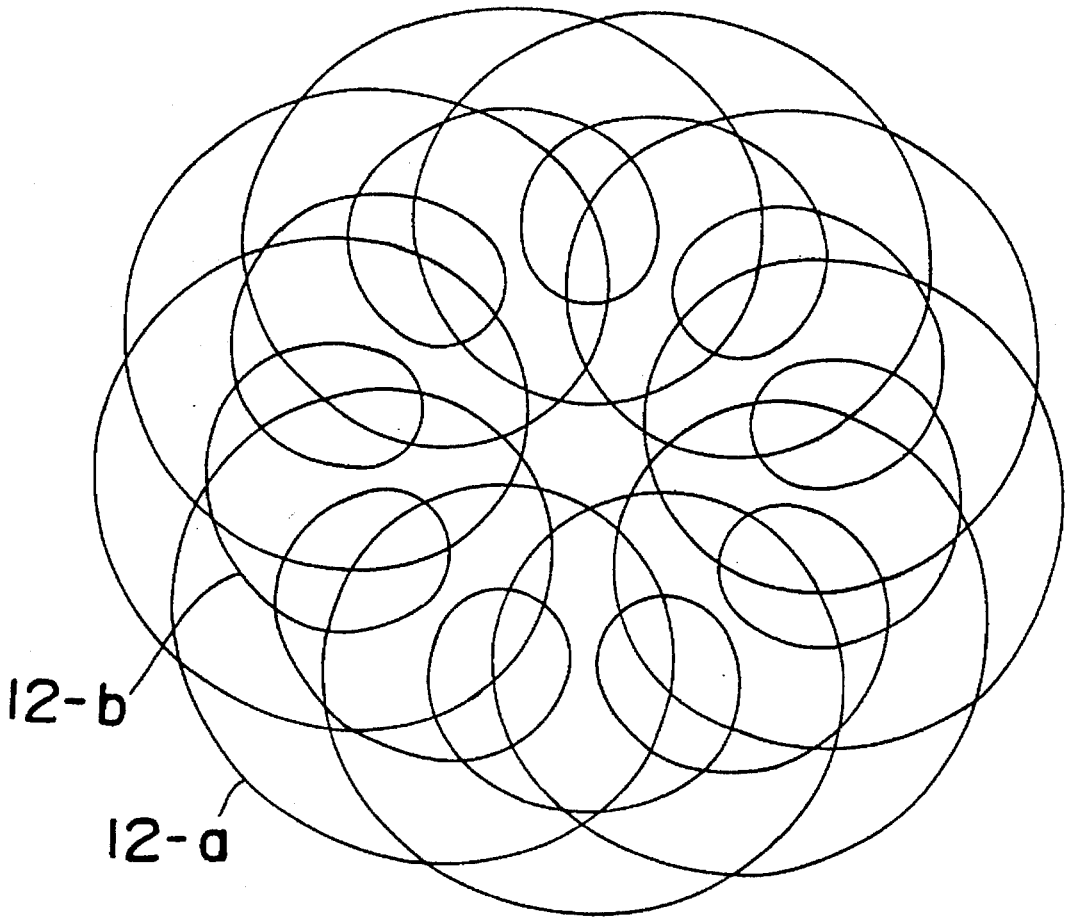
FIG. 2 is a view showing the rotation locus of an opening of a third arm nozzle of the dishwasher shown in FIG. 1.

A dishwasher according to the first embodiment is described below with reference to FIGS. 1 and 2. Referring to FIG. 1, the dishwasher comprises a tank 1; an upper dish container 2 disposed on an upper stage of the tank 1; a lower dish container 3 disposed on a lower stage of the tank 1; a pump 4; a heater 7; and a control device 8. The control device 8 controls a series of operations of the dishwasher comprising water supply, cleaning, washing, water discharge, and drying. The dishwasher further comprises an upper arm nozzle 10, disposed in a space below the upper dish container 2 and rotating substantially horizontally while it is jetting cleaning water toward dishes in the upper dish container 2; a first arm nozzle 11 disposed in a space below the lower dish container 3 and rotating substantially horizontally; a second arm nozzle 12, the rotation axis of which is eccentric in a certain distance from the rotation axis of the first arm nozzle 11, thus rotating on the first arm nozzle 11; jetting openings 11-*a*, 11-*b* and 12-*a* and 12-*b*, formed on each of the first arm nozzle 11 and the second arm nozzle 12, for jetting cleaning water toward dishes in the lower dish container 3; and a first nozzle bearing 13 and a second nozzle bearing 14 for supporting the shaft of the first arm nozzle 11 and that of the second arm nozzle 12, respectively.

The operation of the dishwasher having the above-described construction is described below. Dishes are accommodated in the upper and lower dish containers 2 and 3 and then, the upper and lower dish containers 2 and 3 are installed in the tank 1 at a predetermined position thereof, respectively. Then, a switch is turned on. Initially, a predetermined amount of cleaning water is supplied to the tank 1. Then, cleaning water, including detergent, pressurized by the pump 4 is jetted to the dishes from the upper, first, and second arm nozzles 10, 11, and 12 for a predetermined period of time. Then, cleaning water including leftover or the like washed away from the dishes is discharged from the dishwasher. Thereafter, cleaning water is supplied to the tank 1 and jetted from each arm nozzle to wash dishes so as to remove leftover and detergent which have remained thereon. Then, the cleaning water is discharged from the dishwasher. The cleaning process terminates by repeating these operations four times. The operation performed in the above-described cleaning process is fundamentally similar to that performed in the cleaning process of the conventional dishwasher.

In the above cleaning process, the cleaning water can be uniformly jetted to the lower dish container 3 from the jetting openings 12-*a* and 12-*b* of the second arm nozzle 12. That is, the cleaning water can be jetted to every portion of the dishes placed in the lower dish container 3. A predetermined cleaning performance can be obtained by a small motive power of cleaning water. Although the pump 4 is small, it provides the jetting opening of each of the arm nozzles 11, 12, and 10 with a discharge pressure so that necessary cleaning performance is obtained at each jetting opening. A small motive power of the pump suffices for cleaning the dishes because the entire region in the dish container 3 can be cleaned uniformly. Although the pump 4 is small, it provides a high motive power for reliably and uniformly clean the dishes. In addition, the pump 4 consumes a small electric power and generates a small noise. Further, cleaning water jetted from each jetting opening makes a small noise when it drips to the bottom surface of the tank 1 or collides with the wall thereof. That is, small noises are generated by the dishwasher.

Second Embodiment

Figure 3:
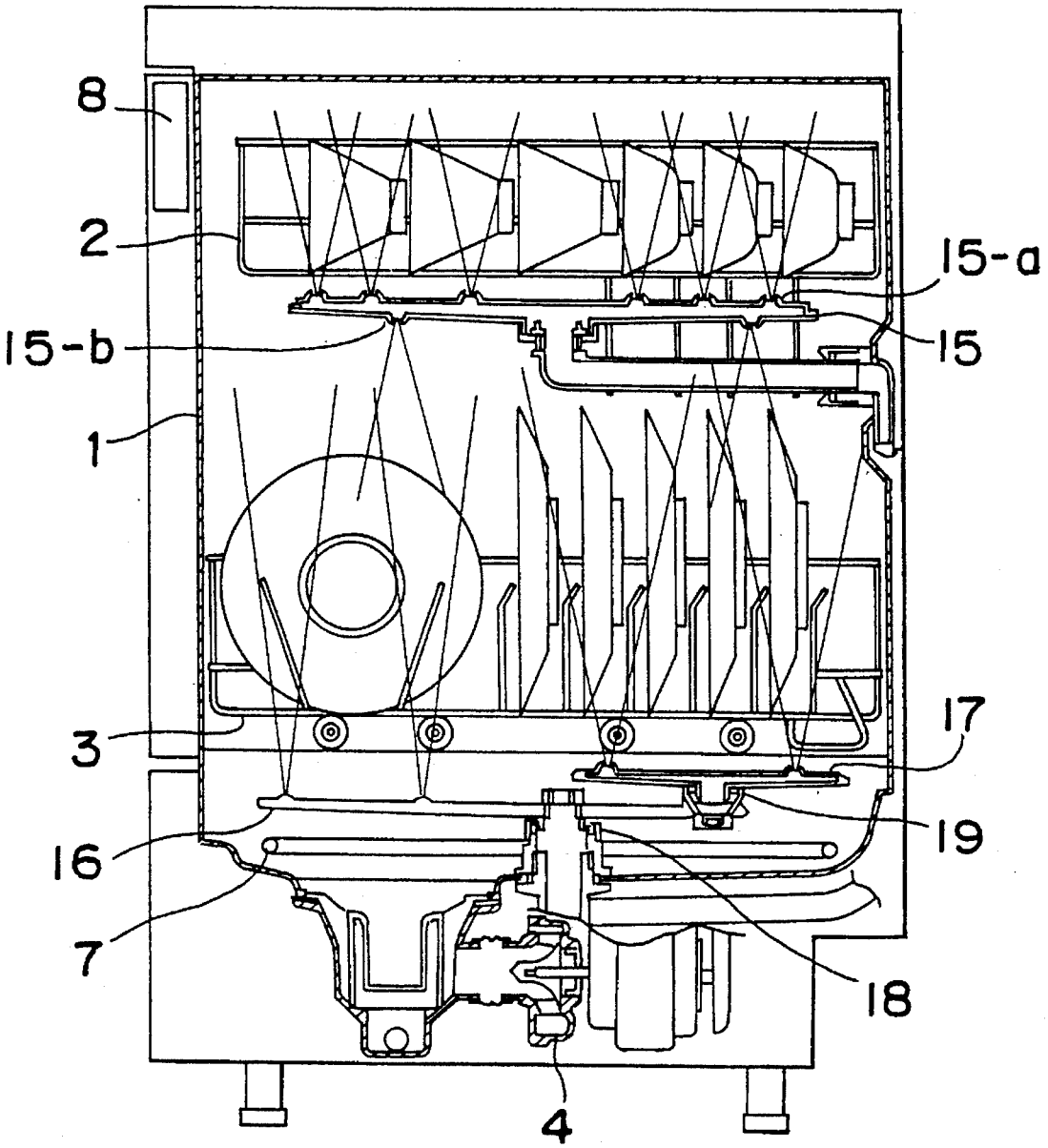
FIG. 3 is a sectional view showing a dishwasher according to a second embodiment of the present invention.

A dishwasher according to the second embodiment is described below with reference to FIG. 3. The dishwasher comprises a tank 1; an upper dish container 2; a lower dish container; a pump 4; a heater 7; and a control device 8. The construction of the dishwasher according to the second embodiment is similar to that of the dishwasher according to the first embodiment except that cleaning means are different from each other. That is, an upper arm nozzle 15 is disposed in a space below the upper dish container 2 and rotates substantially horizontally. The upper arm nozzle 15 has a plurality of jetting openings 15-*a* for jetting cleaning water toward the upper dish container 2 and a plurality of jetting openings 15-*b* for jetting cleaning water toward the lower dish container 3. A first arm nozzle 16 is disposed in a space below the lower dish container 3 and rotates substantially horizontally. A second arm nozzle 17 has a rotation axis eccentric in a certain distance from the rotation axis of the first arm nozzle 16, thus rotating on the second arm nozzle 16. The first and second arm nozzles 16 and 17 jet cleaning water toward dishes in the lower dish container 3. A first nozzle bearing 18 and a second nozzle bearing 19 support the shaft of the second arm nozzle 16 and the second arm nozzle 17, respectively. The upper arm nozzle 15 rotates in a direction opposite to that of either the first arm nozzle 16 or that of the second arm nozzle 17. The operation in the cleaning process according to the second embodiment is similar to that in the cleaning process according to the first embodiment. Therefore, the description of the operation in the cleaning process according to the second embodiment is omitted herein.

In the second embodiment, in addition to the cleaning performance of the first and second arm nozzles 16 and 17 which jet cleaning water uniformly toward the region to be cleaned, cleaning water jetted from the jetting openings 15-*b* prevents leftover or the like washed away from dishes in the upper dish container 2 from attaching to the back surfaces of the dishes placed in the lower dish container 3. In addition, the dishes can be favorably cleaned irrespective of dish-placing directions. That is, the dishwasher according to the second embodiment is superior to that according to the first embodiment in the cleaning performance thereof due to a slight increase in the motive power of cleaning water. Because a cleaning water-supply portion for supplying cleaning water to the upper arm nozzle 15 is of sealing type as disclosed in Japanese Patent Laid-Open Publication No. 4-164428, a small motive power suffices for displaying the above-described cleaning performance and the dishwasher generates a small noise in cleaning operation.

Third Embodiment

Figure 4:
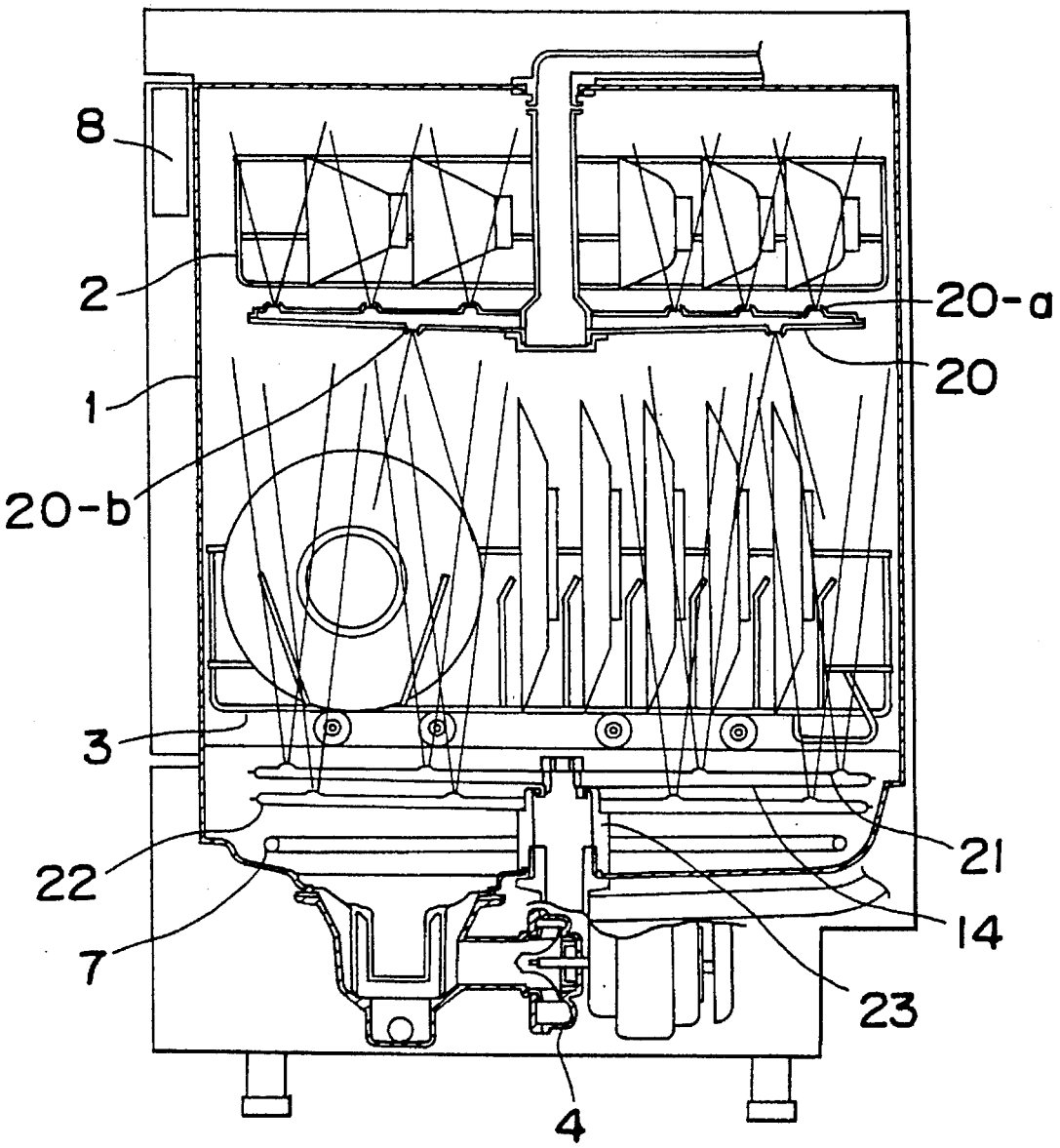
FIG. 4 is a sectional view showing a dishwasher according to a third embodiment of the present invention.

A dishwasher according to the third embodiment is described below with reference to FIG. 4. The dishwasher comprises a tank 1; an upper dish container 2; a lower dish container; a pump 4; a heater 7; and a control device 8. The construction of the dishwasher according to the third embodiment is similar to that of the dishwasher according to the second embodiment except that cleaning means are different from each other. That is, an upper arm nozzle 20 is disposed in a space below the upper dish container 2 and rotates substantially horizontally. The upper arm nozzle 20 has a plurality of jetting openings 20-*a* for jetting cleaning water toward the upper dish container 2 and a plurality of jetting openings 20-*b* for jetting cleaning water toward the lower dish container 3. A first arm nozzle 21 is disposed in a space below the lower dish container 3 and rotates substantially horizontally. A second arm nozzle 22 is also disposed in a space below the lower dish container 3 and is concentric with the first arm nozzle 21. The first and second arm nozzles 21 and 22 rotate in opposite directions, thus jetting cleaning water toward dishes in the lower dish container 3. A nozzle bearing 23 supports the shaft of the second and third arm nozzles 21 and 22. The operation in the cleaning process according to the third embodiment is fundamentally similar to that in the cleaning process according to the first embodiment. Therefore, the description of the operation in the cleaning process according to the third embodiment is omitted herein.

In this embodiment, because the first and second arm nozzles 21 and 22 rotate in opposite directions, cleaning water can be reliably jetted upward toward dishes in the lower dish container 3 irrespective of dish-placing directions. Thus, the dishwasher has an excellent cleaning performance. In addition, as described in the second embodiment, leftover or the like can be prevented from attaching to the back surfaces of dishes placed in the lower dish container 3 owing to cleaning water jetted from the jetting openings 20-*b*. That is, dishes can be favorably cleaned irrespective of dish-placing directions.

Fourth Embodiment

Figure 5:
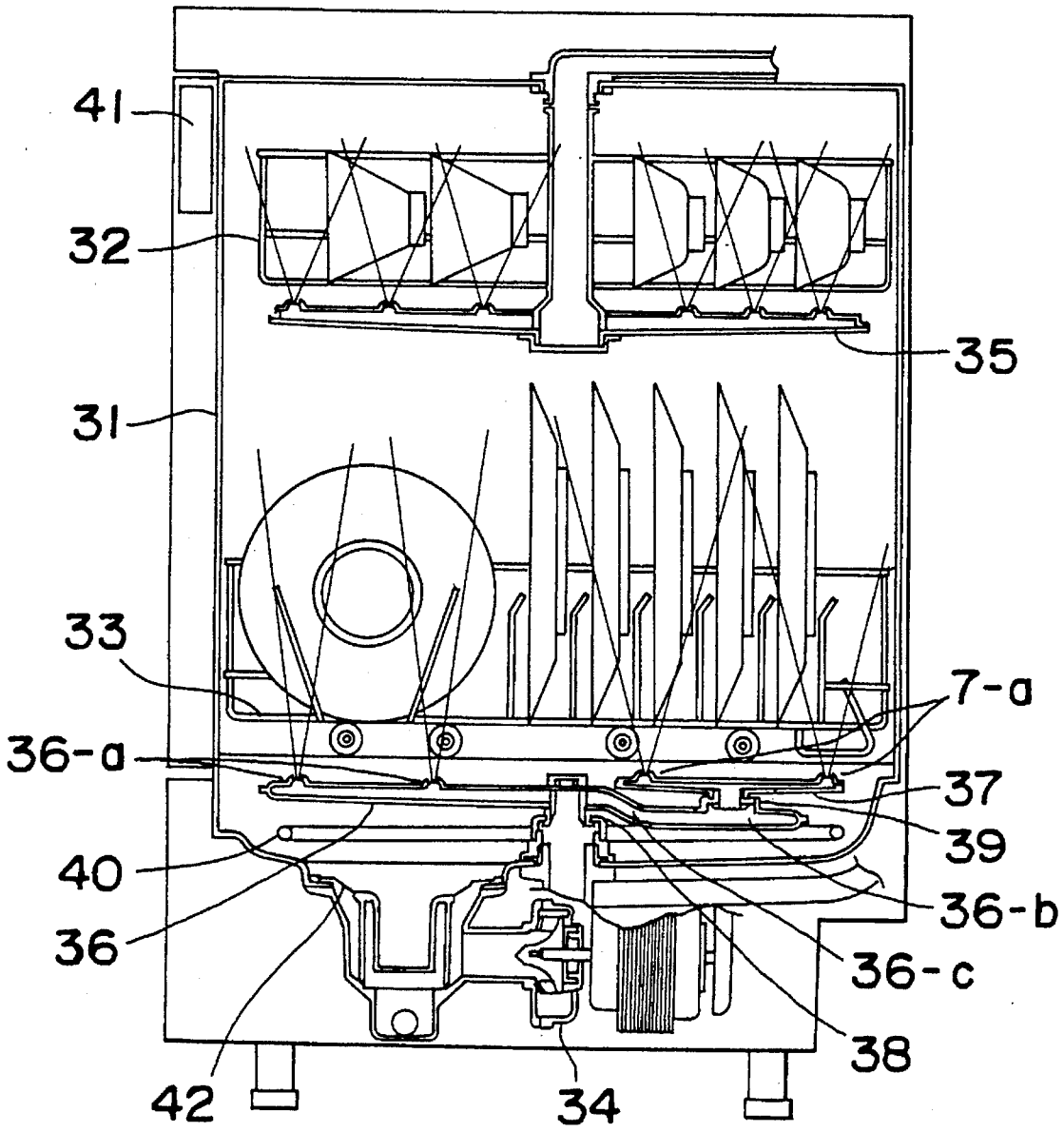
FIG. 5 is a sectional view showing a dishwasher according to a fourth embodiment of the present invention.

A dishwasher according to the fourth embodiment is described below with reference to FIG. 5. The dishwasher comprises a tank 31; an upper dish container 32 disposed on an upper stage of the tank 31; a lower dish container 33 disposed on a lower stage of the tank 31; a pump 34; an upper nozzle 35; a first arm nozzle 36 having a plurality of jetting openings 36-*a* formed thereon; a second arm nozzle 37 having a plurality of jetting openings 37-*a* formed thereon; a first nozzle bearing 38 for rotatably supporting the shaft of the first arm nozzle 36; a second nozzle bearing 39 for rotatably supporting the shaft of the second arm nozzle 37; a heater 40; and a control device 41.

The construction of the dishwasher according to the fourth embodiment is similar to that of the dishwasher according to the first embodiment except that the construction of the first arm nozzle 36 of the former is different from the first arm nozzle 11 of the latter. The first arm nozzle 36 has a conduit 36-*b* on which the second nozzle bearing 39 is mounted. The distance between the bottom surface of the dishwasher and the conduit 36-*b* is shorter than the distance between the bottom surface thereof and the jetting openings 36-*a*. An inclined conduit 36-*c* communicates with the first arm nozzle 36 and the conduit 36-*b*.

The operation of the dishwasher having the above-described construction is described below. Dishes are accommodated in the upper and lower dish containers 32 and 33 and then, the upper and lower dish containers 2 and 3 are installed in the tank 1 at a predetermined position thereof, respectively. Then, a switch is turned on. Initially, a predetermined amount of cleaning water is supplied to the tank 31. Then, cleaning water, including detergent, pressurized by the pump 34 is jetted from the upper nozzle 35, the first arm nozzle 36 and the second arm nozzle 37 for a predetermined period of time. Then, cleaning water including leftover or the like washed away from the dishes is discharged from the dishwasher. Thereafter, cleaning water is supplied to the tank 1 and jetted from each nozzle to wash dishes so as to remove leftover and detergent which have remained on the dishes. Then, the cleaning water is discharged from the dishwasher. The cleaning process terminates by repeating these operations four times. The operation performed in the above-described cleaning process is fundamentally similar to that performed in the cleaning process of the conventional dishwasher.

In the cleaning process, the second arm nozzle 37 rotates on the shaft thereof supported by the second nozzle bearing 39 while the second arm nozzle 37 rotates on the shaft of the first arm nozzle 36 in the cleaning region below the lower dish container 33 in accordance with the rotation of the first arm nozzle 36. Accordingly, cleaning water can be jetted to dishes accommodated in the lower dish container 33 from both the jetting openings 36-*a* formed on the first arm nozzle 36 and the jetting openings 37-*a* formed on the second arm nozzle 37. That is, cleaning water can be jetted to every portion of the dishes accommodated in the lower dish container 33 and thus, a predetermined cleaning performance can be obtained by a small motive power of cleaning water.

That is, in the dishwasher according to the fourth embodiment, a small motive power of the pump 34 and a small quantity of water is sufficient for achieving a predetermined cleaning performance. Further, water jetted from each jetting opening makes a small noise when it collides with the wall of the tank 31. That is, small noises are generated by the dishwasher.

In this embodiment, the first arm nozzle 36 is bent to form the conduit 36-*c* so that the distance between the bottom surface of the dishwasher and the jetting openings 37-*a* of the second arm nozzle 37 is shorter than the distance between the bottom surface thereof and the jetting openings 12-*a* and 12-*b* of the second arm nozzle 12 (first embodiment) corresponding to the second arm nozzle 37. Cleaning water jetted from the jetting openings 37-*a* spreads over the dishes accommodated in the lower dish container 33 widely and uniformly. Therefore, even though the distance between the dishes accommodated in the lower dish container 33 and the jetting openings 37-*a* is set to be shorter than the distance between the dishes accommodated in a lower dish container of a conventional dishwasher and jetting openings of an arm nozzle thereof corresponding to the first arm nozzle 36, the dishwasher according to this embodiment has a more favorable cleaning performance than the conventional dishwasher. Owing to this spacing, the dish-accommodating space can be enlarged.

Fifth Embodiment

Figure 6:
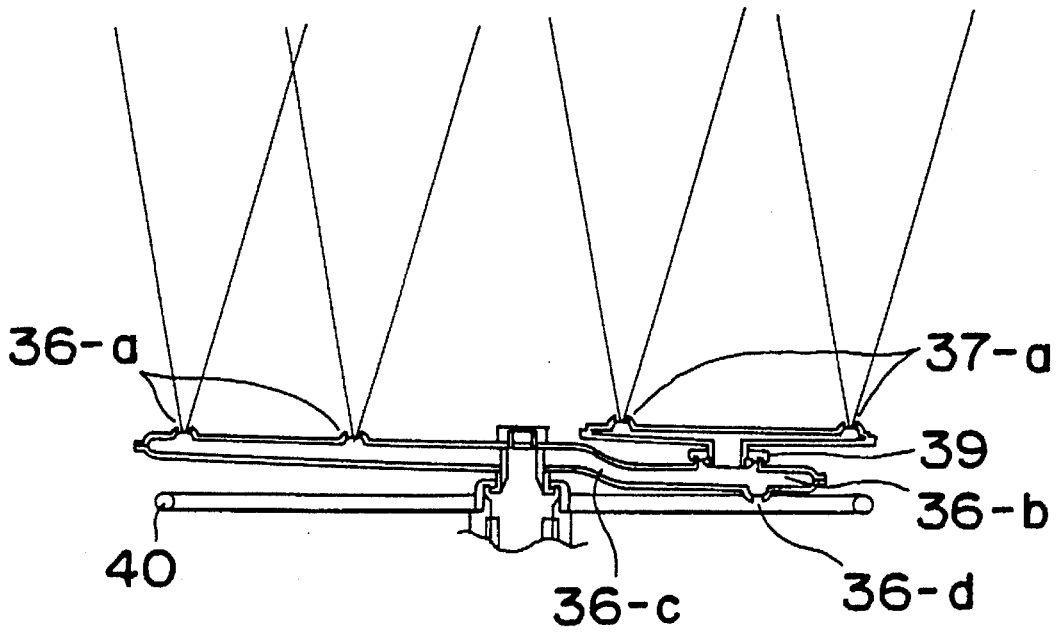
FIG. 6 is a sectional view showing principal portions of a cleaning nozzle of a dishwasher according to a fifth embodiment of the present invention.

A dishwasher according to the fifth embodiment is described below with reference to FIG. 6. The fundamental construction of the dishwasher according to the fifth embodiment is similar to that of the dishwasher according to the fourth embodiment except for the construction of a cleaning nozzle. Therefore, the description of the construction of the dishwasher according to the fifth embodiment is omitted herein. That is, in the fifth embodiment, a jetting opening 36-*d* is formed on the bottom surface of the conduit 36-*b* on which the second nozzle bearing 39 is mounted.

The operation of the dishwasher having the above-described construction is described below. During cleaning process, cleaning water is being continuously jetted from the jetting opening 36-*d* toward the bottom of the tank 31. Accordingly, during the cleaning process, leftover can be effectively collected by a filter 42 and thus, the bottom of the tank 31 is clean. That is, leftover does not remain on the bottom of the tank 31, thus not emitting a bad smell. In this manner, the interior of the tank 1 can be kept to be sanitary. In addition, when each cleaning process has terminated or the operation of the dishwasher has been stopped, cleaning water filling the first arm nozzle 36 and the second arm nozzle 37 is reliably discharged from the jetting opening 36-*d* in a short period of time. Therefore, the first arm nozzle 36 and the second arm nozzle 37 can become stationary horizontally. That is, the rotational regions of the cleaning nozzles can be reduced and thus a dish-accommodating region can be enlarged.

Sixth Embodiment

Figure 7:
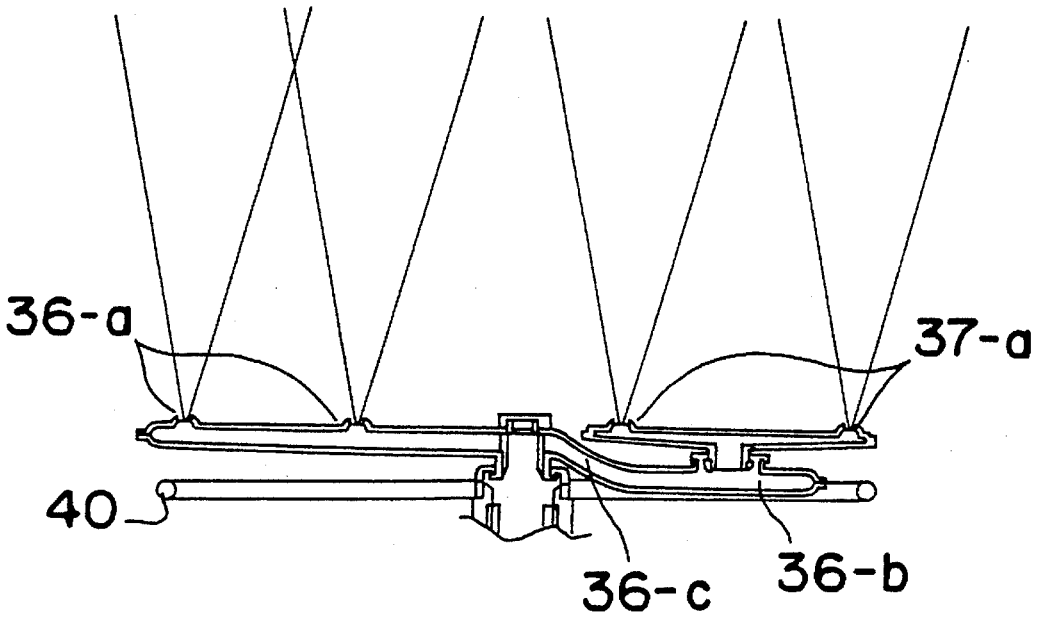
FIG. 7 is a sectional view showing principal portions of a cleaning nozzle of a dishwasher according to a sixth embodiment of the present invention.

A dishwasher according to the sixth embodiment is described below with reference to FIG. 5. The fundamental construction of the dishwasher according to the sixth embodiment is similar to that of the dishwasher according to the fourth embodiment except for the construction of a cleaning nozzle. Therefore, the construction of the dishwasher according to the sixth embodiment is omitted herein. In the sixth embodiment, the cleaning nozzle having a construction as shown in FIG. 7 is used. That is, the upper surface of the jetting opening 36-*a* of the first arm nozzle 36 and the jetting opening 37-*a* of the second arm nozzle 37 rotate, with the upper surfaces of both jetting openings 36-*a* and 37-*a* flush with each other. Therefore, the distance between the upper surface of the jetting opening 36-*a* and the lower dish container 33 is equal to the distance between the jetting opening 37-*a* and the lower dish container 33.

The operation of the dishwasher having the above-described construction is described below. The distance between the jetting opening 36-*a* and the dishes accommodated in the lower dish container 33 is equal to the distance between the jetting opening 37-*a* and the dishes accommodated in the lower dish container 33. That is, the distance between the region to be cleaned and the jetting opening 36-*a* is equal to the distance between the region to be cleaned and the jetting opening 37-*a*. Accordingly, the distance between the lower dish container 33 and the first arm nozzle 36 can be appropriately selected depending on the configuration of both jetting openings 36-*a* and 37-*a*. That is, the cleaning force of cleaning water jetted from the jetting openings 36-*a* and 7-*a* can be utilized very effectively. That is, a high cleaning performance can be obtained by a small motive power of cleaning water. In addition, a small quantity of water suffices for cleaning dishes and thus the dishwasher generates a small noise.

In combination of the construction according to the sixth embodiment and that according to the fifth embodiment, in addition to the above-described advantages, the rotational regions of the cleaning nozzles can be further reduced and moreover, the dish-accommodating region can be further enlarged.

Seventh Embodiment

Figure 8:
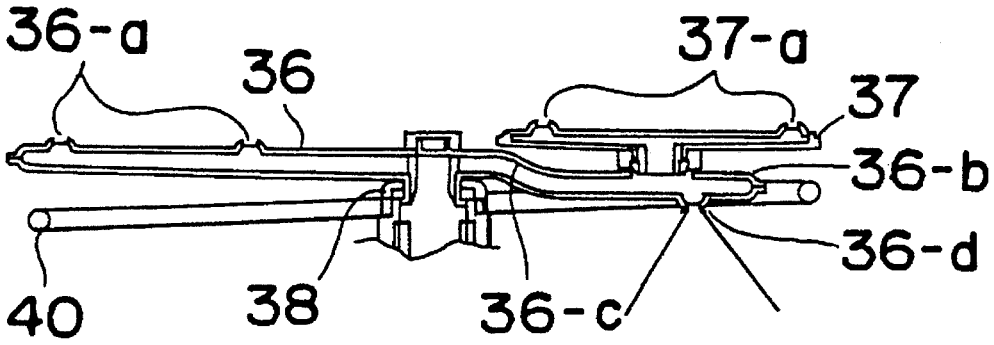
FIG. 8 is a sectional view showing principal portions of a cleaning nozzle of a dishwasher according to a seventh embodiment of the present invention.

A dishwasher according to the seventh embodiment is described below with reference to FIG. 6. The fundamental construction of the dishwasher according to the seventh embodiment is similar to that of the dishwasher according to the first embodiment except for the construction of a cleaning nozzle. Therefore, the construction of the dishwasher according to the seventh embodiment is omitted herein. In the seventh embodiment, the cleaning nozzle having a construction as shown in FIG. 8 is used. That is, the rotation axis of the first arm nozzle 36 is eccentric in a predetermined distance toward the rotation axis of the second arm nozzle 37. That is, the center of gravity of the first arm nozzle 36 is different from the rotation axis thereof. Thus, when the pump 34 has stopped, the first arm nozzle 36 inclines toward the second arm nozzle 37 and becomes stationary.

The operation of the dishwasher having the above-described construction is described below. When cleaning process has terminated, the first arm nozzle 36 inclines toward the second arm nozzle 37, thus becoming stationary. Therefore, cleaning water is discharged from the first arm nozzle 36 in a short period of time, with the first arm nozzle 36 keeps inclining. Accordingly, the distance between the heater 40 and the bottom surface of the first arm nozzle 36 as well as the second arm nozzle 37 is constant. That is, in the seventh embodiment, the temperature of every portion of the first arm nozzle 36 and the second arm nozzle 37 does not rise beyond a permissible range in drying process. Thus, the dishwasher can be used with safety.

The center of gravity of the first arm nozzle 36 is set by making the position of the rotation axis thereof eccentric toward the second arm nozzle 37. But instead, it is possible to make a certain portion of the material of the first arm nozzle 36 thicker than other portions or install parts on the first arm nozzle 36 at a certain portion thereof.

In combination of the construction according to the seventh embodiment and that according to the fourth embodiment or the fifth embodiment, an appropriate distance can be obtained between the heater 40 and the first arm nozzle 36 as sell as the second arm nozzle 37. Thus, the cleaning nozzles can be made of resin at a low cst. Further, the dishwasher provides an efficient cleaning performance and consumes a small quantity of water.

Eighth Embodiment

Figure 9:
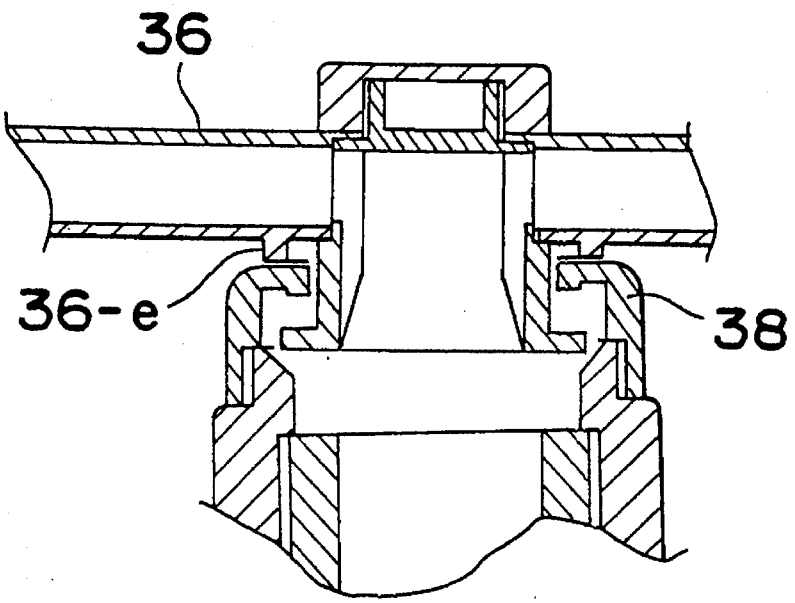
FIG. 9 is a sectional view showing principal portions of a cleaning nozzle of a dishwasher according to an eighth embodiment of the present invention.
Figure 10:
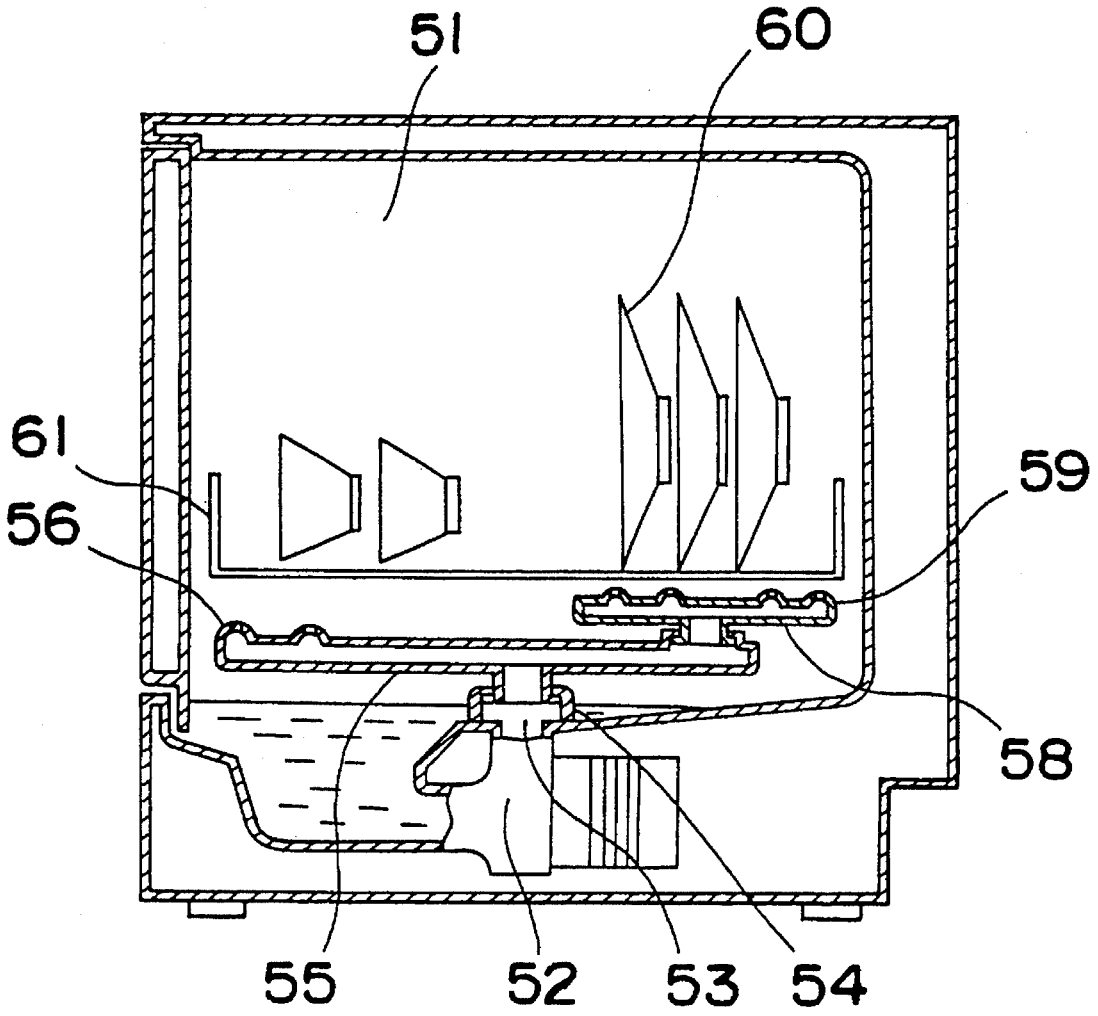
FIG. 10 is a vertical sectional view showing a dishwasher according to a ninth embodiment of the present invention.

A dishwasher according to the eighth embodiment is described below with reference to FIG. 7. The fundamental construction of the dishwasher according to the eighth embodiment is similar to that of the dishwasher according to the first embodiment except for the construction of the cleaning nozzle. Therefore, the description of the construction of the dishwasher according to the seventh embodiment is omitted herein. In the eighth embodiment, the cleaning nozzle having a construction as shown in FIG. 9 is used. That is, an approximately annular projection 36-*e* is formed on the bottom surface of first arm nozzle 36. The projection 36-*e* is integral with the first arm nozzle 36. When the operation of the pump 4 has stopped, the projection 36-*e* is brought into contact with the nozzle bearing 38 and thus the first arm nozzle 36 becomes stationary. The lower surface of the projection is inclined with respect to a horizontal plane so that the vertical length of the projection is shorter on the second arm nozzle side than the side opposite to the second arm nozzle. Although not shown in FIG. 9, the first arm nozzle 36 has the jetting opening 36-*d* formed on the lower surface thereof, similarly to the fifth embodiment.

The operation of the dishwasher having the above-described construction is described below. When cleaning process has terminated, the projection 36-*e* is brought into contact with the nozzle bearing 38 and thus the first arm nozzle 36 becomes stationary. At this time, since the lower surface of the projection is inclined with respect to a horizontal plane so that the vertical length of the projection is shorter on the second arm nozzle side than the side opposite to the second arm nozzle, the first arm nozzle 36 inclines to one side, namely, to the second arm nozzle 37, thus becoming stationary. Accordingly, cleaning water and leftover or the like left in the cleaning nozzle in the cleaning process can be reliably discharged from the jetting opening 36-*d*. Thus, a very sanitary dishwasher can be provided by the eighth embodiment.

Instead of the projection 36-*e* formed on the lower surface of the first arm nozzle 36, it is possible to form a plurality of projections provided that the lower surfaces of the projections are inclined with respect to a horizontal plane so that the vertical lengths of the projections are shorter on the second arm nozzle side than the side opposite to the second arm nozzle 37. In combination of the construction of the dishwasher according to the eighth embodiment with the construction of the dishwasher according to the fourth embodiment or sixth embodiment, similarly to the seventh embodiment, the cleaning nozzle can be composed of resin at a low cost and in addition, the dishwasher provides an efficient cleaning performance and consumes a small quantity of water.

In combination of the construction of the dishwasher according to the eighth embodiment with the construction of the dishwasher according to the fourth and sixth embodiments, cleaning water can be reliably discharged from the first arm nozzle 36 in a short period of time, and an appropriate distance can be obtained between the cleaning nozzles and the heater 12. Further, the dishwasher can be manufactured at a low cost and used safely. Moreover, the dishwasher is sanitary and convenient to use.

In the fourth through eighth embodiments, the dishwashers have a plurality of dish containers vertically disposed. But needless to say, a dishwasher having one dish container and the first and second arm nozzles is capable of displaying a similar advantage.

Ninth Embodiment

A dishwasher according to the ninth embodiment is described below with reference to FIG. 10 through 14. The dishwasher comprises a tank 51 accommodating dishes 60 set in a dish container 61; a pump 52 for pressurizing and circulating cleaning water; a first arm nozzle 55 communicating with a discharge opening 53 of the pump 52 and rotating substantially horizontally; a second arm nozzle 58 having an axis eccentric in a predetermined distance from the rotation axis 01 of the first arm nozzle 55 and rotating substantially horizontally on the first arm nozzle 55; a first jetting opening 56 comprising a plurality of openings formed on the first arm nozzle 55; a second jetting opening 59 comprising a plurality of openings formed on the second arm nozzle 58; and an opening 58 formed at the rotation center of the second arm nozzle 58.

The operation of the dishwasher having the above-described construction is described below with reference to FIGS. 10 through 14. The dish container 61 on which the dishes 60 have been set is accommodated in the tank 51. Upon start of drive, a predetermined amount of cleaning water is supplied to the tank 51 according to a predetermined sequence. Then, the pump 52 is actuated. As a result, the pressurized predetermined amount of cleaning water is fed to the first arm nozzle 55 via the discharge opening 53 and jetted upward from the second jetting openings 59. Remaining cleaning water is fed to the second arm nozzle 58 via the first arm nozzle 55 and jetted upward from the second jetting openings 59. At this time, the cleaning water is jetted obliquely upward from at least one first jetting opening 56 along approximately the tangent to the rotation locus thereof. Due to the horizontal component of the reaction, to the jetting force, generated at this time, the first arm nozzle 55 rotates clockwise, thus jetting cleaning water toward the dishes 60 obliquely upward from the first jetting opening 56 along approximately the tangent to the rotation locus thereof. The second arm nozzle 58 rotates on the axis 01 of the first arm nozzle 55 in accordance with the rotation of the first arm nozzle 55. At the same time, cleaning water is jetted from at least one second jetting openings 59 obliquely upward along approximately the tangent to the rotation locus thereof. Due to the horizontal component of the reaction, to the jetting force, generated at this time, the second arm nozzle 58 rotates counterclockwise on the axis 02 thereof, thus jetting cleaning water toward the dishes 60 obliquely upward from the second jetting openings 59 along approximately the tangent to the rotation locus thereof.

The number of the second jetting openings 59 is greater than that of the first jetting openings 56. Therefore, the total amount of cleaning water jetted from the former is greater than that jetted from the latter.

Figure 13:
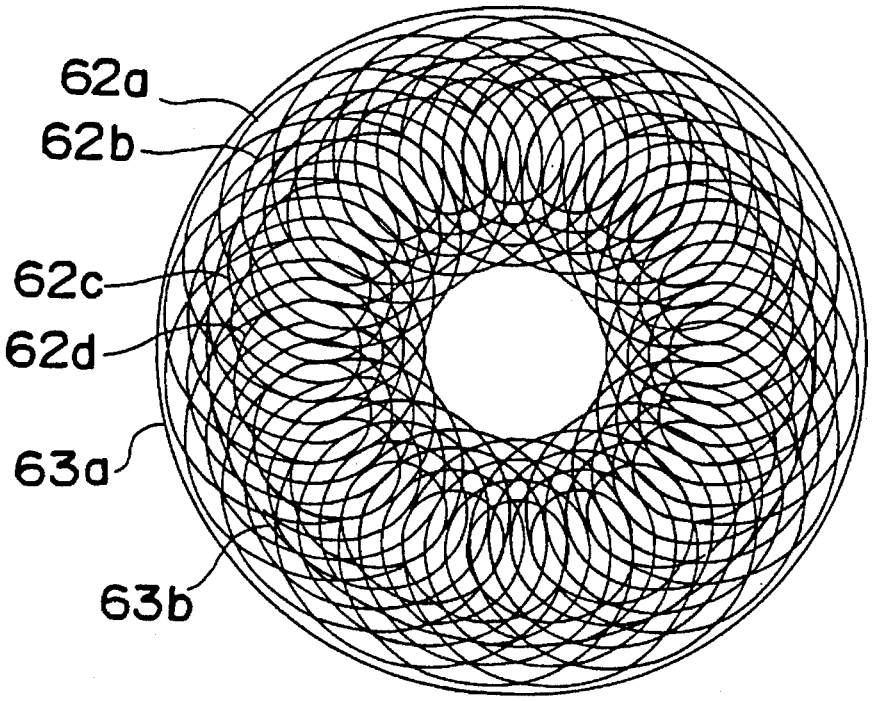
FIG. 13 is a view showing a motion locus of a jetting opening formed on the arm nozzle of the dishwasher according to the ninth embodiment of the present invention.
Figure 14:
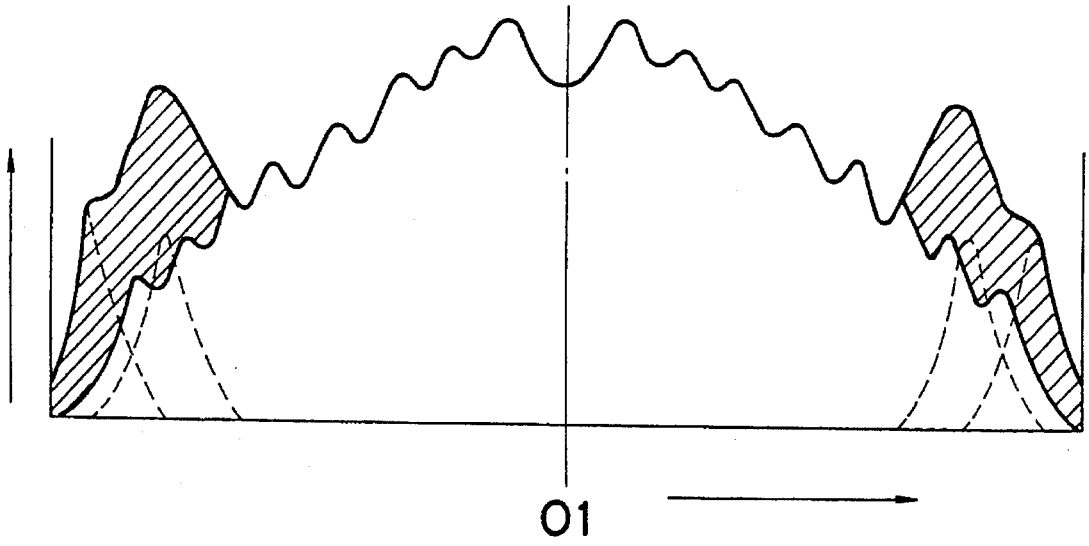
FIG. 14 is view showing an energy density distribution generated at a jetting opening formed on the arm nozzle of the dishwasher according to the ninth embodiment of the present invention.

FIG. 13 shows the motion locus of the first and second jetting openings 56 and 59 by solid lines. The motion loci of the second jetting openings 59 are represented by 62*a*, 62*b*, 62*c*, and 62*d* while the motion loci of the first jetting openings 56 are shown by 63*a* and 63*b*. As shown in FIG. 13, the level of the energy density of cleaning water jetted from the second jetting openings 59 can be easily understood by analogical inference. FIG. 14 shows the energy density distribution of the cleaning water jetted from the second jetting openings 59 quantitatively. In FIG. 14, the ordinate shows the energy density (W) of the cleaning water and the abscissa denotes the position of the radius (R) of a circle, the center of which is 01 of the first arm nozzle 55. A curve indicated by a mountain-shaped solid line shows the distribution of the energy density of the cleaning water jetted from the second jetting openings 59, and portions, with oblique lines, disposed at both ends of the abscissa show synthetic energy distribution generated by the addition of the energy density of the cleaning water jetted from the first jetting openings 56 to the energy density of the cleaning water jetted from the second jetting openings 59. As indicated in FIG. 14, the energy density of the cleaning water jetted from the second jetting openings 59 has a higher level than the energy density of the cleaning water jetted from the first jetting openings 56 throughout the cleaning range. That is, the second jetting openings 59 contribute much to the cleaning performance.

Figure 11:
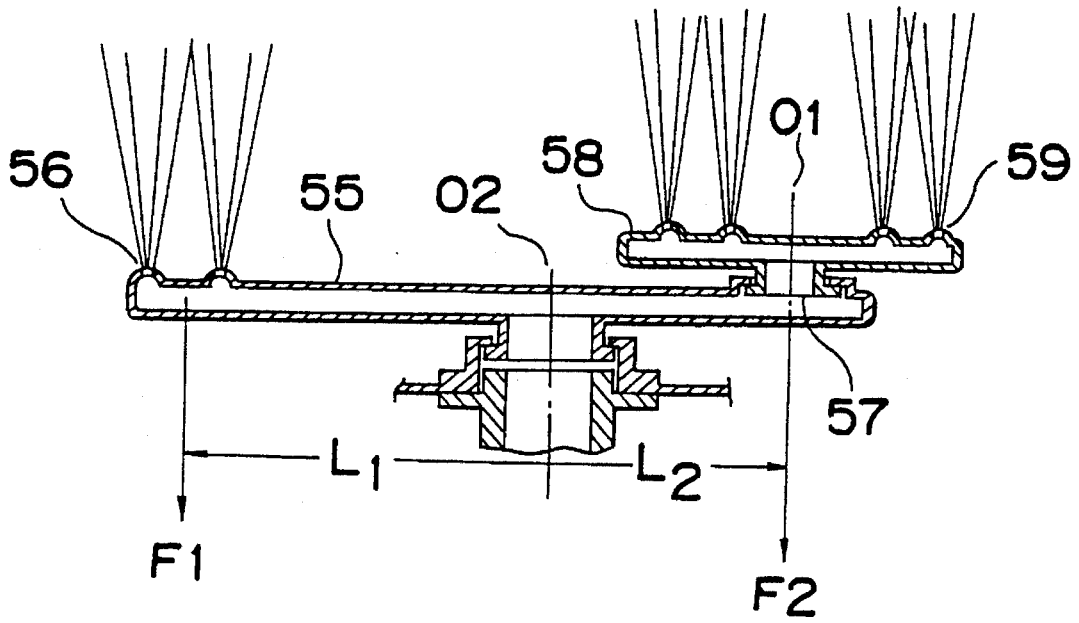
FIG. 11 is a vertical sectional view showing an arm nozzle of the dishwasher according to the ninth embodiment of the present invention.
Figure 12:
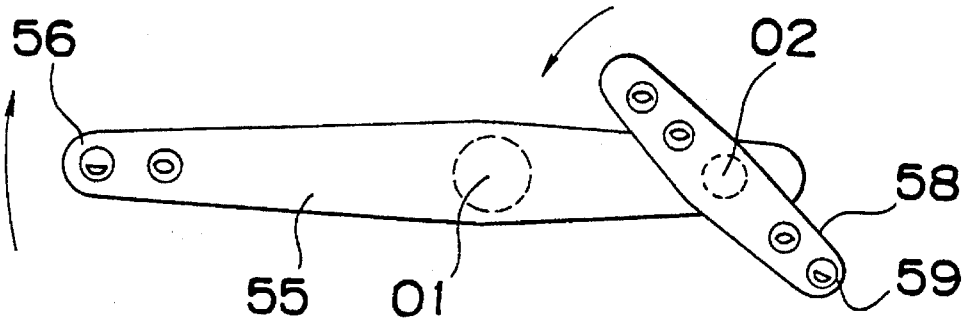
FIG. 12 is a plan view showing the arm nozzle of the dishwasher according to the ninth embodiment of the present invention.

Consequently, the total reaction F2, to the jetting force, of the second jetting openings 59 is greater than the total reaction F1, to the jetting force, of the first jetting openings 56 as shown in FIG. 11. Therefore, the magnitude of the reaction F2 and that of the reaction F1 at the rotation center 02 of the second arm nozzle 58 are almost inversely proportional to the distance L1 between the rotation center 01 of the first arm nozzle 55 and the position at which the reaction F1 is generated in the left arm thereof and the distance L2 between the rotation center 01 of the first arm nozzle 55 and the position at which the reaction F2 is generated in the right arm thereof, respectively. The product of the distance L1 and the reaction F1 is almost equal to the product of the distance L2 and the reaction F2. Accordingly, the downward moments generated on the first arm nozzle 55 about the rotation center 01 are balanced with each other. Thus, the first and second arm nozzles 55 and 58 rotate smoothly and water can be prevented from leaking from a rotary sealing portion.

As described above, the energy density of the cleaning water jetted from the second jetting openings 59 is uniform and thus the cleaning water can be uniformly jetted to dishes in the tank and in addition, the first and second arm nozzles 55 and 58 rotate smoothly. Further, water can be prevented from leaking from the rotary sealing portion. Accordingly, the dishes in the tank can be uniformly cleaned and hence a high cleaning performance can be achieved.

Tenth Embodiment

Figure 15:
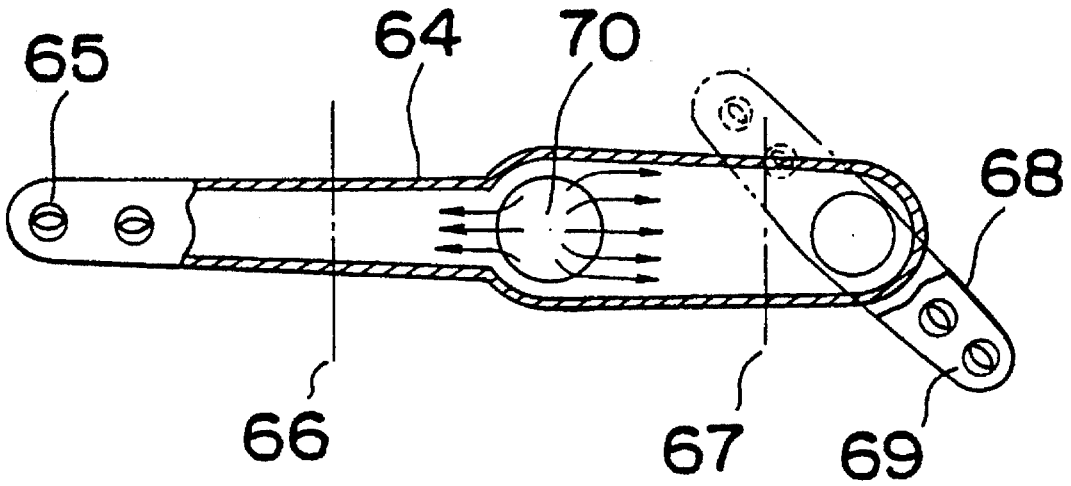
FIG. 15 is a horizontal sectional view showing an arm nozzle of a dishwasher according to a tenth embodiment of the present invention.
Figure 16:
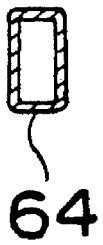
FIG. 16 is a transverse sectional view showing an arm of the dishwasher according to the tenth embodiment of the present invention.
Figure 17:
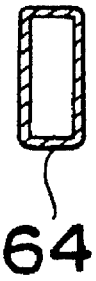
FIG. 17 is a transverse sectional view showing the arm of the dishwasher according to the tenth embodiment of the present invention.

A dishwasher according to the tenth embodiment is described below with reference to FIG. 15 through 17. FIG. 15 is a horizontal sectional view showing a first arm nozzle 64 rotatable and communicating with a discharge opening of a pump. FIG. 16 is a sectional view, showing an arm of the first arm nozzle 64 disposed on a first jetting opening 65 side, taken along a given line 66. FIG. 17 is a sectional view, showing an arm of the first arm nozzle 64 disposed on a second arm nozzle 68 side, taken along a given line 67. The line 66 and the line 67 are symmetrical with respect to the rotation axis of the first arm nozzle 64.

Reference numeral 70 denotes an opening for supplying cleaning water to the first arm nozzle 64; and 68 denotes a second arm nozzle having a plurality of second openings 69. At every position of the first arm nozzle 64, the vertical sectional area of a plane, at a given position, of the arm on the first jetting opening side is set to be smaller than that of a plane, at a given position, of the arm on the second arm nozzle side supposing that the thickness of the wall of one arm of the first arm nozzle 64 is equal to the thickness of the wall of the other arm of the first arm nozzle 64. The two given points are symmetrical with respect to the rotation axis of the first arm nozzle 64.

The operation of the dishwasher having the above-described construction is described below. The fundamental operation of the tenth embodiment is similar to that of the ninth embodiment. Therefore, the description of the fundamental operation is omitted herein. Upon actuation of the pump 2, cleaning water is supplied from the opening 70 into the first arm nozzle 64. The pipe resistance in the arm on the second arm nozzle 68 side is smaller than that in the arm on the first jetting opening 65 side, and thus pressure loss on the second arm nozzle 68 side is smaller than that on the first jetting opening 65 side. Therefore, as shown by arrows of FIG. 15, the amount of cleaning water to be supplied to the second arm nozzle 68 side is greater than that of cleaning water to be supplied to the first jetting opening 65 side. That is, the flow rate in the second arm nozzle 68 side is greater than that in the first jetting opening 65 side. Thus, the discharge pressure at the second jetting opening 69 can be suppressed to the minimum. Accordingly, the output of the second jetting opening 69, namely, the motive power of cleaning water at the second jetting opening 69 is greater than the motive power of cleaning water at the first jetting opening 65, thus contributing to the improvement of energy density of cleaning water and cleaning efficiency. As a result, the downward moments generated on the first arm nozzle 64 are balanced with each other and water leakage from a rotary sealing portion can be reduced to the minimum.

As described above, in the tenth embodiment, the energy density of the cleaning water jetted from the second jetting openings 69 is uniform and thus the cleaning water can be uniformly jetted to dishes in the tank and in addition, the first arm nozzle 64 rotate smoothly. Further, water can be prevented from leaking from the rotary sealing portion. Accordingly, the dishes in the tank can be uniformly cleaned and hence a high cleaning performance can be achieved.

Eleventh Embodiment

Figure 18:
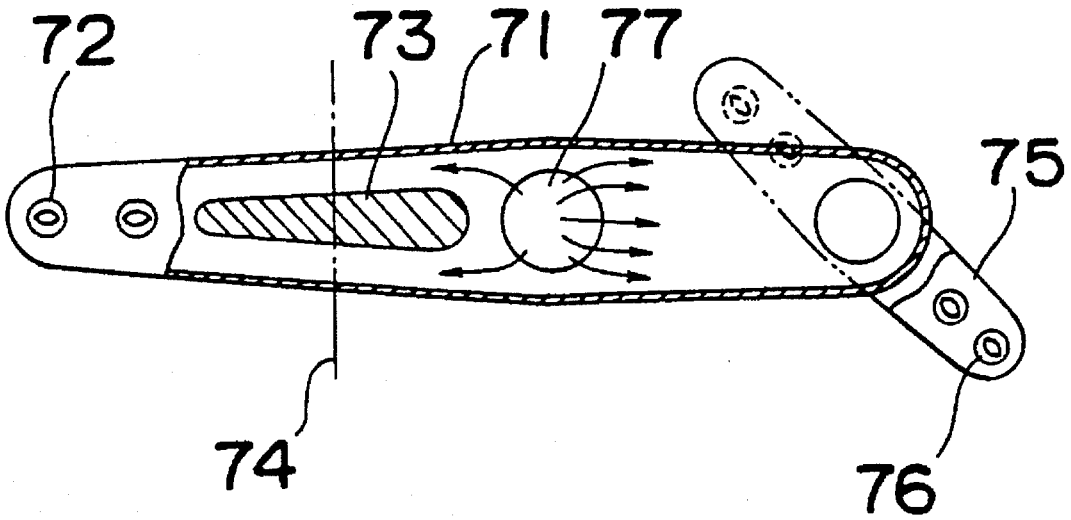
FIG. 18 is a horizontal sectional view showing an arm nozzle of a dishwasher according to an eleventh embodiment of the present invention.
Figure 19:
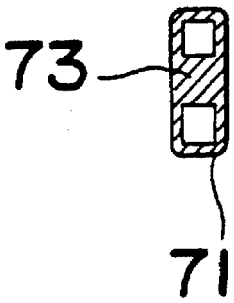
FIG. 19 is a transverse sectional view showing the arm according to the eleventh embodiment of the present invention.

A dishwasher according to the eleventh embodiment is described below with reference to FIG. 18 and 19. FIG. 18 is a horizontal sectional view showing a first arm nozzle 71 rotatable and communicating with a discharge opening of a pump. FIG. 19 is a sectional view, showing a left arm of the first arm nozzle 71, taken along a line at a given position 74 disposed on a first jetting opening 72 side. Reference numeral 77 denotes an opening for supplying cleaning water to the first arm nozzle 71; 73 denotes a flowing water throttle vane; and 75 denotes a second arm nozzle having a plurality of second jetting openings 76. The sectional area of the arm pipe on the first jetting opening 72 side is set to be smaller than that of the arm pipe on the second arm nozzle 75 side.

The operation of the dishwasher having the above-described construction is described below. The fundamental operation of the tenth embodiment is similar to that of the ninth embodiment. Therefore, the description of the fundamental operation is omitted herein. Upon actuation of the pump 2, cleaning water is supplied from the opening 77 into the first arm nozzle 71. The pipe resistance in the arm on the second arm nozzle 75 side is smaller than that in the arm on the first jetting opening 72 side having the throttle vane 73, and thus pressure loss on the second arm nozzle 75 side is smaller than that on the first jetting opening 72 side. Therefore, as shown by arrows of FIG. 18, the amount of cleaning water to be supplied to the second arm nozzle 75 side is greater than that of cleaning water to be supplied to the first jetting opening 72 side. That is, the flow rate in the second arm nozzle 75 side is greater than that in the first jetting opening 72 side. Thus, the discharge pressure at the second jetting openings 76 can be suppressed to the minimum. Accordingly, the output of the second jetting opening 76, namely, the motive power of cleaning water at the second jetting opening 76 is greater than the motive power of cleaning water at the first jetting opening 72, thus contributing to the improvement of energy density of cleaning water and cleaning efficiency. As a result, the downward moments generated on the first arm nozzle 71 are balanced with each other and water leakage from a rotary sealing portion can be reduced to the minimum.

As described above, in the eleventh embodiment, the energy density of the cleaning water jetted from the second jetting openings 69 is uniform and thus the cleaning water can be uniformly jetted to dishes in the tank and in addition, the first arm nozzle 71 rotate smoothly. Further, water can be prevented from leaking from the rotary sealing portion. Accordingly, the dishes in the tank can be uniformly cleaned and hence a high cleaning performance can be achieved.

Twelfth Embodiment

Figure 20:
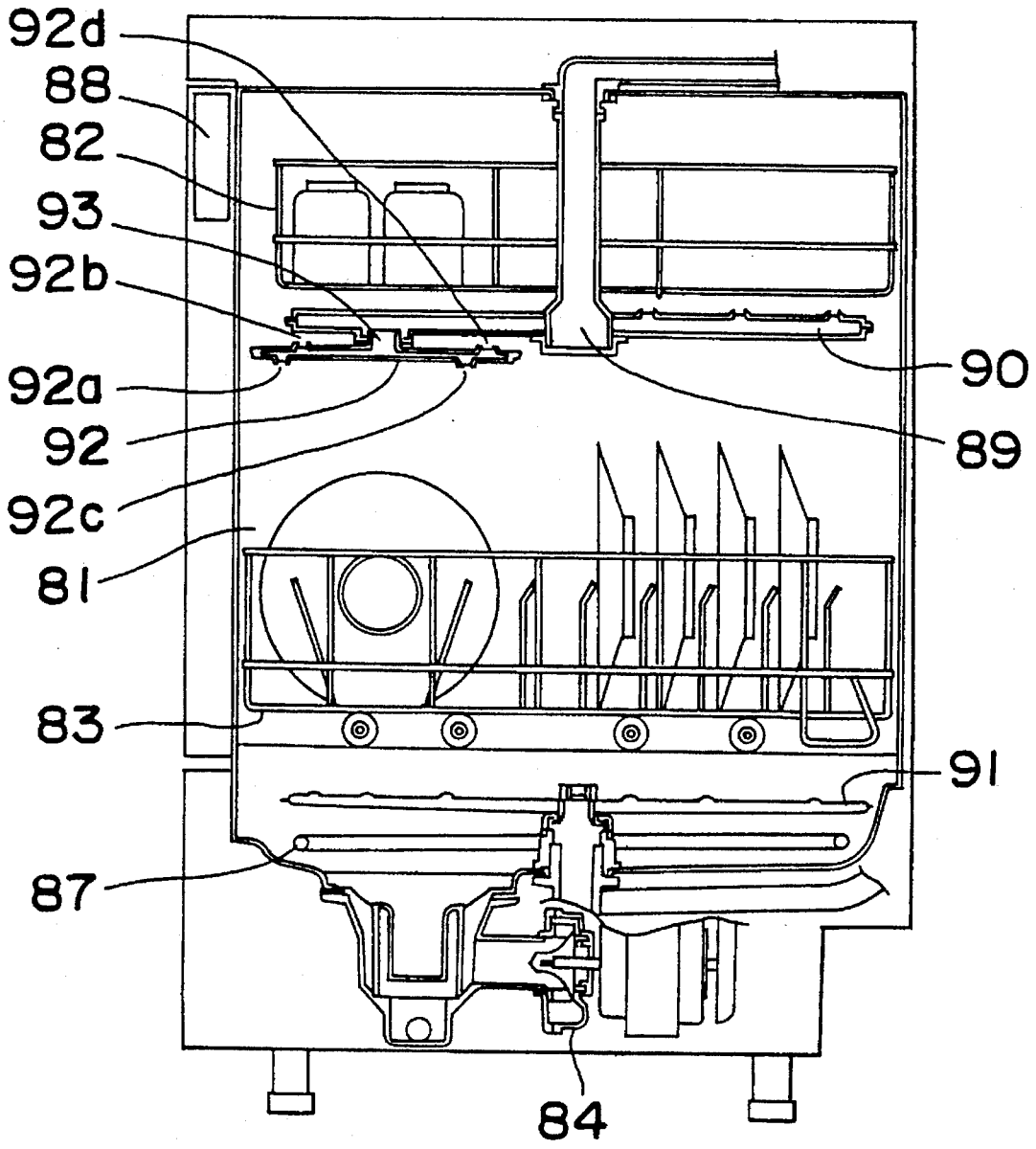
FIG. 20 is a sectional view showing a dishwasher according to twelfth and thirteenth embodiments of the present invention.

A dishwasher according to the twelfth embodiment is described below with reference to FIGS. 20 and 21. The dishwasher comprises a tank 81; an upper dish container 82 disposed on an upper stage of the tank 81; a lower dish container 83 disposed on a lower stage of the tank 81; a pump 84 for pressurizing and circulating cleaning water; a heater 87 for heating cleaning water; and a control device 88 for controlling the drive of the pump 84 and that of the heater 87; a first arm nozzle 90 disposed in a space below the upper dish container 82 and rotating substantially horizontally while it is jetting cleaning water upward toward the upper dish container 82; a second arm nozzle 91 disposed in a space below the lower dish container 83 and rotating substantially horizontally while it is jetting cleaning water upward toward the lower dish container 83; a third arm nozzle 92 having a rotation axis eccentric a predetermined distance from the rotation axis of the first arm nozzle 90 and rotating on the first arm nozzle 90. There are formed on the first arm nozzle 92 a plurality of jetting openings 92*a*, 92*bc*, 92*c*, and 92*d* for jetting cleaning water toward dishes accommodated in the upper dish container 82 or the lower dish container 83. The first, second, and third arm nozzles 90, 91, and 92 constitute cleaning means for jetting cleaning water to dishes.

A shaft 89 supports the first arm nozzle 90 and a shaft 93 supports the third arm nozzle 92.

The operation of the dishwasher having the above-described construction is described below. Initially, dishes are accommodated in the upper and lower dish containers 82 and 83 and then, the upper and lower dish containers 2 and 3 are installed in the tank 81 at a predetermined position thereof, respectively. Then, a switch is turned on. Initially, a predetermined amount of cleaning water is supplied to the tank 81. Then, cleaning water, including detergent, pressurized by the pump 84 is jetted from the first, second, and third arm nozzle 90, 91, and 92 for a predetermined period of time. Then, cleaning water including leftover or the like washed away from dishes is discharged from the dishwasher. Thereafter, cleaning water is supplied to the tank 81 and jetted from each nozzle to wash the dishes so as to remove leftover and detergent which have remained on the dishes. Then, the cleaning water is discharged from the dishwasher. The cleaning process terminates by repeating these operations three to four times. The operation performed in the above-described cleaning process is fundamentally similar to that performed in the cleaning process of the conventional dishwasher.

Figure 21:
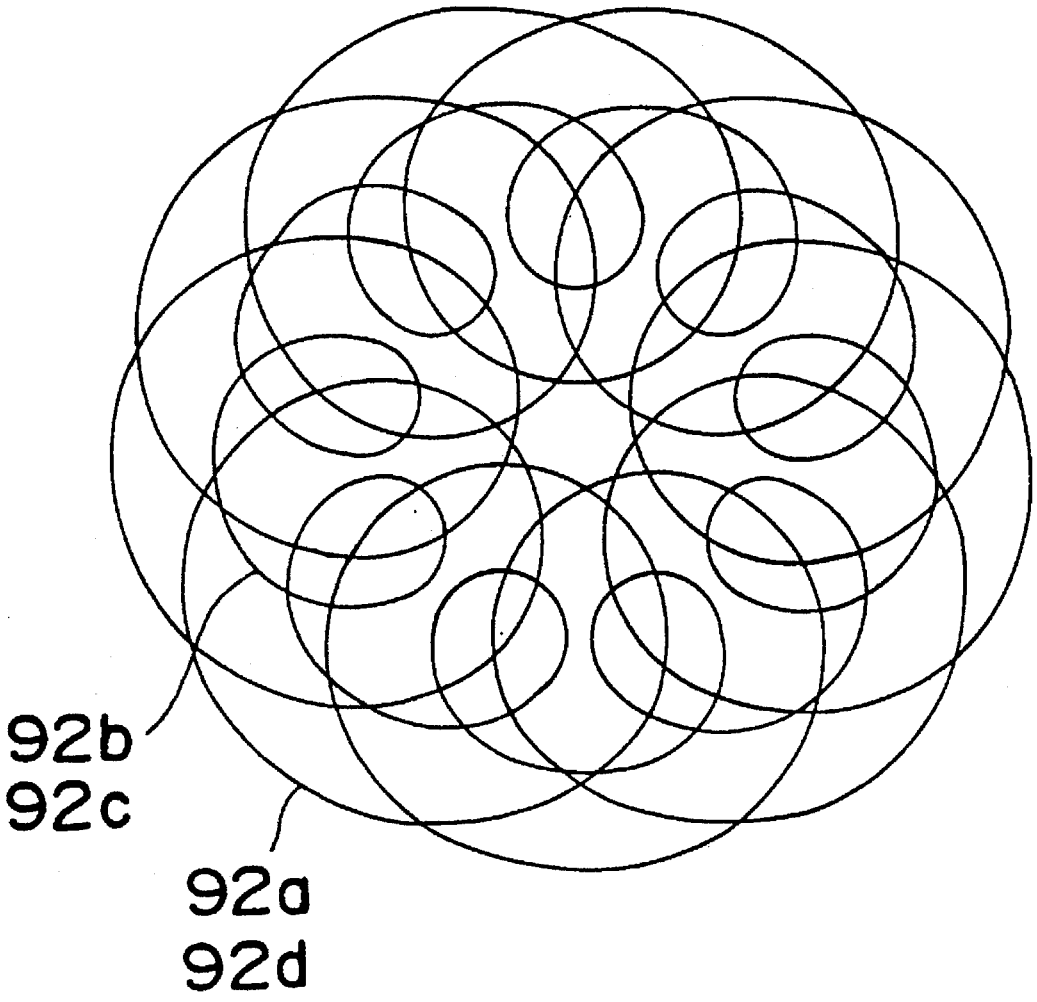
FIG. 21 is a view showing the rotation locus of a jetting opening of a third arm nozzle of a dishwasher according to the twelfth and thirteenth embodiments of the present invention.
Figure 22:
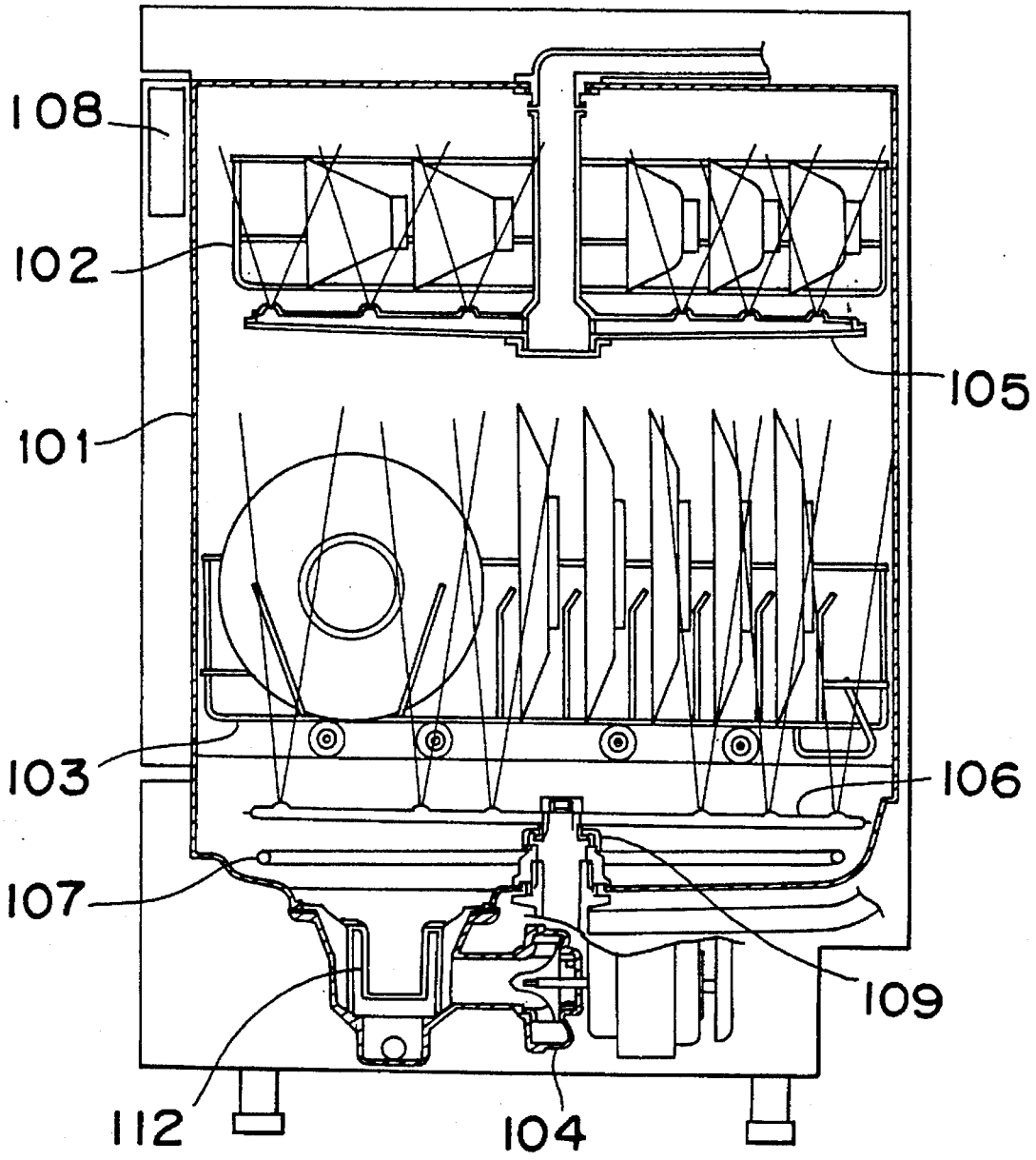
Fig.22 PRIOR ART
FIG. 22 is a sectional view showing a conventional dishwasher.

In the cleaning and washing processes, the third arm nozzle 92 rotates on the shaft 93 thereof while the third arm nozzle 92 rotates on the shaft 89 of the first arm nozzle 90, thus jetting cleaning water toward dishes placed in the upper and lower dish containers 82 and 83 in all directions from the jetting openings 92*a*, 92*c*, 92*b*, and 92*c* as shown in FIG. 21. Accordingly, the cleaning water can be jetted to every portion of each dish, thus cleaning the dishes efficiently. Thus, the quantity of the cleaning water to be jetted from the first and second arm nozzles 90 and 91 toward the upper and lower dish containers 82 and 83 can be reduced to a great extent. Further, a predetermined cleaning performance can be obtained by a smaller motive power of cleaning water compared with the motive power consumed by the conventional dishwasher because a discharge pressure necessary for providing a predetermined cleaning performance can be obtained at each of the arm nozzles 90, 91, and 92. That is, in the dishwasher according to the twelfth embodiment, a small motive power of the pump 84 and a small quantity of water is sufficient for achieving a predetermined cleaning performance. Further, water jetted from each jetting opening makes a small noise when it collides with the wall of the tank 81. That is, small noises are generated by the dishwasher.

A dishwasher according to the thirteenth embodiment is described below with reference to FIG. 20. The third arm nozzle 92 rotates on its shaft 93 in the direction opposite to the rotational direction of either the first arm nozzle 90 or the second arm nozzle 91. The other constructions and cleaning process of this embodiment are similar to those of the twelfth embodiment. But the first arm nozzle 90 or the second arm nozzle 91 may rotate in the same direction.

In addition to the uniform cleaning performance provided by the third arm nozzle 92 which jets cleaning water to the upper and lower regions to be cleaned, the following advantages can be obtained in this embodiment. That is, cleaning water can be jetted to both upper and lower surfaces of each dish accommodated in the upper and lower dish containers 82 and 83. Therefore, leftover or the like washed away from dishes can be prevented from attaching to the back surfaces of every dish. In addition, every dish can be favorably cleaned irrespective of dish-placing directions. That is, every dish in the upper and lower dish containers can be cleaned to a great degree by rotating the arm nozzles in reverse direction.

Although the present invention has been fully described in connection with the preferred embodiments thereof with reference to the accompanying drawings, it is apparent to those skilled in the art. Such changes and modifications are to be understood as included within the scope of the present invention as defined by the appended claims unless they depart therefrom.

What is claimed is:

1. A dishwasher comprising: a cleaning tank; a heater disposed at the bottom of the cleaning tank; a plurality of dish containers disposed vertically in the cleaning tank, said dish containers including upper and lower dish containers; a pump for pressurizing cleaning water; and cleaning nozzles defining a plurality of jetting openings communicating with said pump for jetting cleaning water, the cleaning nozzles including an upper arm nozzle, a first arm nozzle, and a second arm nozzle; said upper arm nozzle being disposed in a space below the upper dish container and supported to rotate substantially horizontally; said first arm nozzle being disposed in a space below the lower dish container and supported to rotate substantially horizontally, and said first arm nozzle having a first conduit extending above said heater, and a second conduit disposed at a level below said first conduit in the cleaning tank and located closer to said heater than said first conduit, said conduits having interior spaces that are open to each other; and said second arm nozzle having a rotational axis eccentric to the rotational axis of the first arm nozzle and rotatably supported on said second conduit of the first arm nozzle.

2. A dishwasher as defined in claim 1, and further comprising a nozzle bearing supporting said first arm nozzle, and a second nozzle bearing supporting the second arm nozzle at a level lower than the top of of said first conduit of the first arm nozzle.

3. A dishwasher as defined in claim 2, wherein each jetting opening of the first arm nozzle is located in approximately the same plane of rotation as each jetting nozzle of the second arm nozzle.

4. A dishwasher as defined in claim 3, wherein the first arm nozzle has its center of gravity spaced a predetermined distance from the rotational axis of the first arm nozzle toward the rotational axis of the second arm nozzle.

5. A dishwasher as defined in claim 4, wherein said first arm nozzle includes a throttle vane formed inside said first conduit so that the internal sectional area of the first conduit is smaller than that of the second conduit, the thickness of the wall of the conduits of said first arm nozzle being uniform.

6. A dishwasher as defined in claim 3, wherein the first arm nozzle has a projection on the lower surface thereof such that the projection is brought into contact with the nozzle bearing supporting the first arm nozzle when the operation of the pump stops, and the lower surface of the projection is inclined with respect to a horizontal plane with the vertical length of the projection being shorter on a side thereof closer to the second arm nozzle than on a side thereof remote from the second arm nozzle.

7. A dishwasher as defined in claim 2, wherein the first arm nozzle has a projection on the lower surface thereof such that the projection is brought into contact with the nozzle bearing supporting the first arm nozzle when the operation of the pump stops, and the lower surface of the projection is inclined with respect to a horizontal plane with the vertical length of the projection being shorter on a side thereof closer to the second arm nozzle than on a side thereof remote from the second arm nozzle.

8. A dishwasher as defined in claim 2, wherein the first arm nozzle has a jetting opening at a lower surface thereof, said jetting opening at the lower surface of the first arm nozzle communicating with said pump so as to let cleaning water toward the bottom of said tank.

9. A dishwasher as defined in claim 8, wherein the first arm nozzle has a projection on the lower surface thereof such that the projection is brought into contact with the nozzle bearing supporting the first arm nozzle when the operation of the pump stops, and the lower surface of the projection is inclined with respect to a horizontal plane with the vertical length of the projection being shorter on a side thereof closer to the second arm nozzle than on a side thereof remote from the second arm nozzle.

10. A dishwasher as defined in claim 9, wherein the third arm nozzle rotates in a direction opposite to a direction in which one of the first arm nozzle and the second arm nozzle rotates.

11. A dishwasher as defined in claim 8, wherein each jetting opening of the first arm nozzle, with the exception of the jetting opening at the lower surface thereof, is located in approximately the same plane of rotation as each jetting nozzle of the second arm nozzle.

12. A dishwasher as defined in claim 8, wherein the first arm nozzle has its center of gravity spaced a predetermined distance from the rotational axis of the first arm nozzle toward the rotational axis of the second arm nozzle, the jetting openings of said first arm nozzle are defined in the first conduit thereof, and said first arm nozzle is supported so as to be tiltable relative to said rotational axis thereof, said first arm nozzle when empty inclining to a position at which the lower surface of said first conduit and the lower surface of the second arm nozzle are located the same distance from said heater.

13. A dishwasher as defined in claim 11, wherein the first arm nozzle has a projection on the lower surface thereof such that the projection is brought into contact with the nozzle bearing supporting the first arm nozzle when the operation of the pump stops, and the lower surface of the projection is inclined with respect to a horizontal plane with the vertical length of the projection being shorter on a side thereof closer to the second arm nozzle than on a side thereof remote from the second arm nozzle.

14. A dishwasher as defined in claim 2, wherein the first arm nozzle has its center of gravity spaced a predetermined distance from the rotational axis of the first arm nozzle toward the rotational axis of the second arm nozzle, the jetting openings of said first arm nozzle are defined in the first conduit thereof, and said first arm nozzle is supported so as to be tiltable relative to said rotational axis thereof, said first arm nozzle when empty inclining to a position at which the lower surface of said first conduit and the lower surface of the second arm nozzle are located the same distance from said heater.

15. A dishwasher as claimed in claim 1, wherein said first arm nozzle also has a third conduit extending between and connecting said first and said second conduits, said third conduit extending longitudinally at an inclination relative to said first and said second conduits.

16. A dishwasher as defined in claim 1, wherein the upper arm nozzle has a plurality of jetting openings, for jetting cleaning water toward dishes in the lower dish container, on a bottom surface of the upper arm nozzle; and the upper arm nozzle rotates in a direction opposite to one of the first arm nozzle and the second arm nozzle.

* * * * *